US010391732B2

(12) United States Patent
Tanaka

(10) Patent No.: US 10,391,732 B2
(45) Date of Patent: Aug. 27, 2019

(54) LABEL PRODUCING APPARATUS

(71) Applicant: Brother Kogyo Kabushiki Kaisha, Nagoya-shi, Aichi-ken (JP)

(72) Inventor: Mitsugi Tanaka, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/924,488

(22) Filed: Mar. 19, 2018

(65) Prior Publication Data

US 2018/0281335 A1 Oct. 4, 2018

(30) Foreign Application Priority Data

Apr. 3, 2017 (JP) ..... 2017-073627

(51) Int. Cl.
*B41J 11/70* (2006.01)
*B41J 3/407* (2006.01)
(Continued)

(52) U.S. Cl.
CPC ..... *B31D 1/026* (2013.01); *B31D 1/021* (2013.01); *B31D 1/027* (2013.01); *B41J 2/32* (2013.01);
(Continued)

(58) Field of Classification Search
CPC ..... B41J 11/66; B41J 11/663; B41J 11/666; B41J 11/70; B41J 11/703; B41J 11/706;
(Continued)

(56) References Cited

U.S. PATENT DOCUMENTS 8,979,406 B2 3/2015 Kasugai et al.
2005/0001892 A1* 1/2005 Yoshihisa ..... B41J 13/0009 347/104
(Continued)

FOREIGN PATENT DOCUMENTS

JP H05-176107 A 7/1993
JP 2005-053093 A 3/2005
(Continued)

*Primary Examiner* — Scott A Richmond
(74) *Attorney, Agent, or Firm* — Banner & Witcoff, Ltd.

(57) ABSTRACT

The disclosure discloses a label producing apparatus including a driving roller, a driven roller, a driving force transmission mechanism, and a coordination adjusting mechanism. The driving roller is disposed to a downstream side of a movable blade on a tape feeding path and configured to contact and discharge a label tape. The driven roller is configured to advance and retreat with respect to the tape feeding path. The driving force transmission mechanism is configured to perform a switching operation between a transmission state where a driving force of a motor is transmitted to the driving roller and an interruption state where the transmission of the driving force to the driving roller is interrupted. The coordination adjusting mechanism is configured to adjust an advancing and retreating operation of the driven roller, an advancing and retreating operation of the movable blade, and the switching operation of the driving force transmission mechanism into a desired mutually coordinated-mode, these operations being performed by the driving force of the motor in accordance with a rotation of the motor in one direction.

11 Claims, 30 Drawing Sheets

(51) Int. Cl.

| | |
|---|---|
| ***B31D 1/02*** | (2006.01) |
| ***B65H 16/00*** | (2006.01) |
| ***B65H 35/00*** | (2006.01) |
| ***B65H 35/06*** | (2006.01) |
| ***B41J 2/32*** | (2006.01) |
| ***B41J 15/04*** | (2006.01) |
| *B65H 20/02* | (2006.01) |

(52) U.S. Cl.
CPC ..... *B41J 3/4075* (2013.01); *B41J 11/703* (2013.01); *B41J 11/706* (2013.01); *B41J 15/046* (2013.01); *B65H 16/005* (2013.01); *B65H 35/006* (2013.01); *B65H 35/06* (2013.01); *B31D 2201/02* (2013.01); *B65H 20/02* (2013.01); *B65H 2701/192* (2013.01)

(58) Field of Classification Search
CPC ..... B41J 2/32; B41J 3/24; B41J 3/407; B41J 15/044; B41J 15/046; B31D 1/026; B65H 16/00; B65H 35/04; B65H 35/06; B65H 35/08; B65H 35/0006; B65H 35/006; B65H 35/008; B65H 35/0086
See application file for complete search history.

(56) References Cited

U.S. PATENT DOCUMENTS

| | | | | |
|---|---|---|---|---|
| 2013/0209154 | A1* | 8/2013 | Kasugai ..... | B41J 2/32 400/611 |
| 2015/0084262 | A1 | 3/2015 | Sago et al. | |

FOREIGN PATENT DOCUMENTS

| | | | |
|---|---|---|---|
| JP | 2012-139778 | A | 7/2012 |
| JP | 2015-085507 | A | 5/2015 |

* cited by examiner

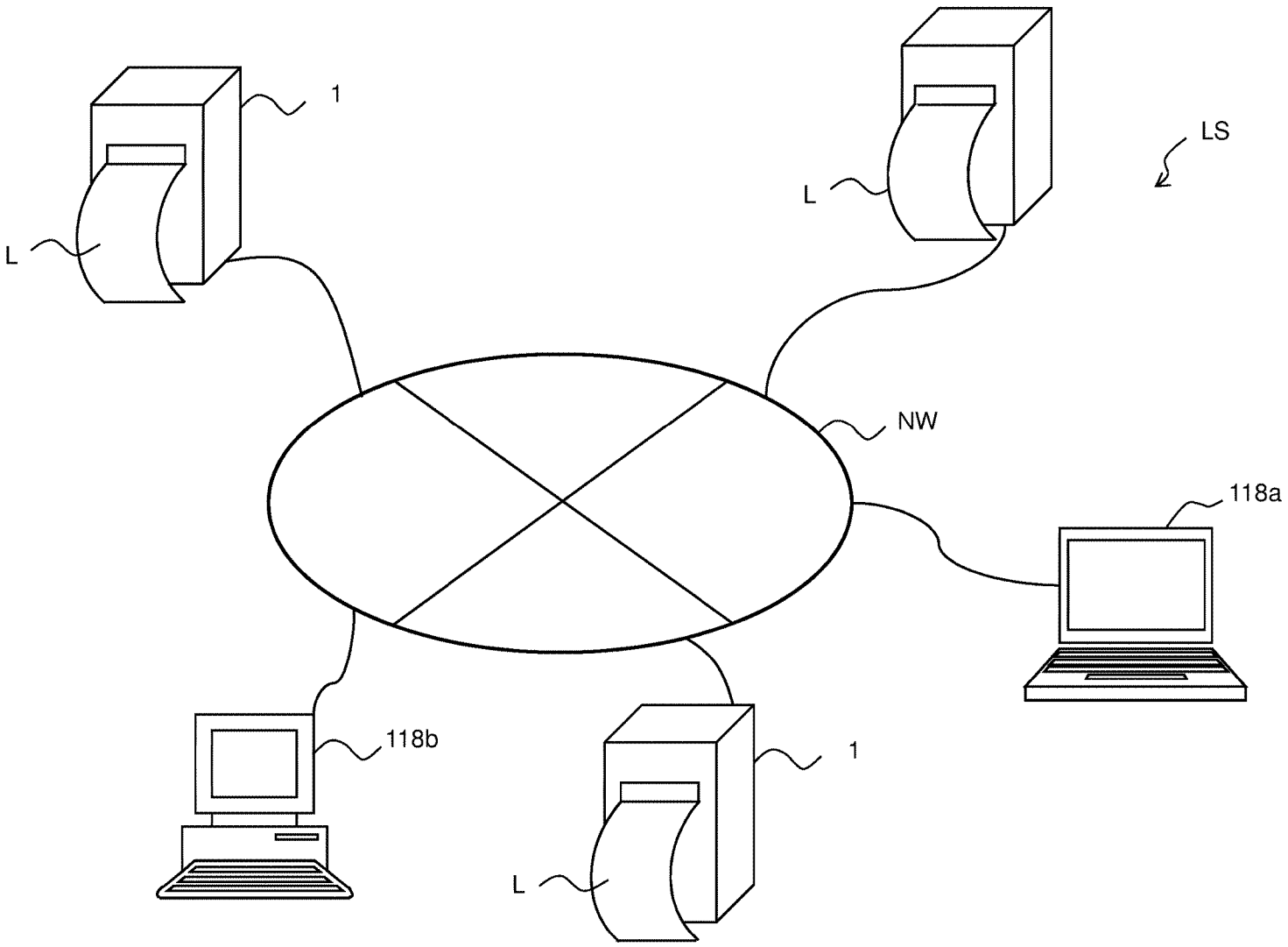
[FIG. 1]

[FIG. 2]
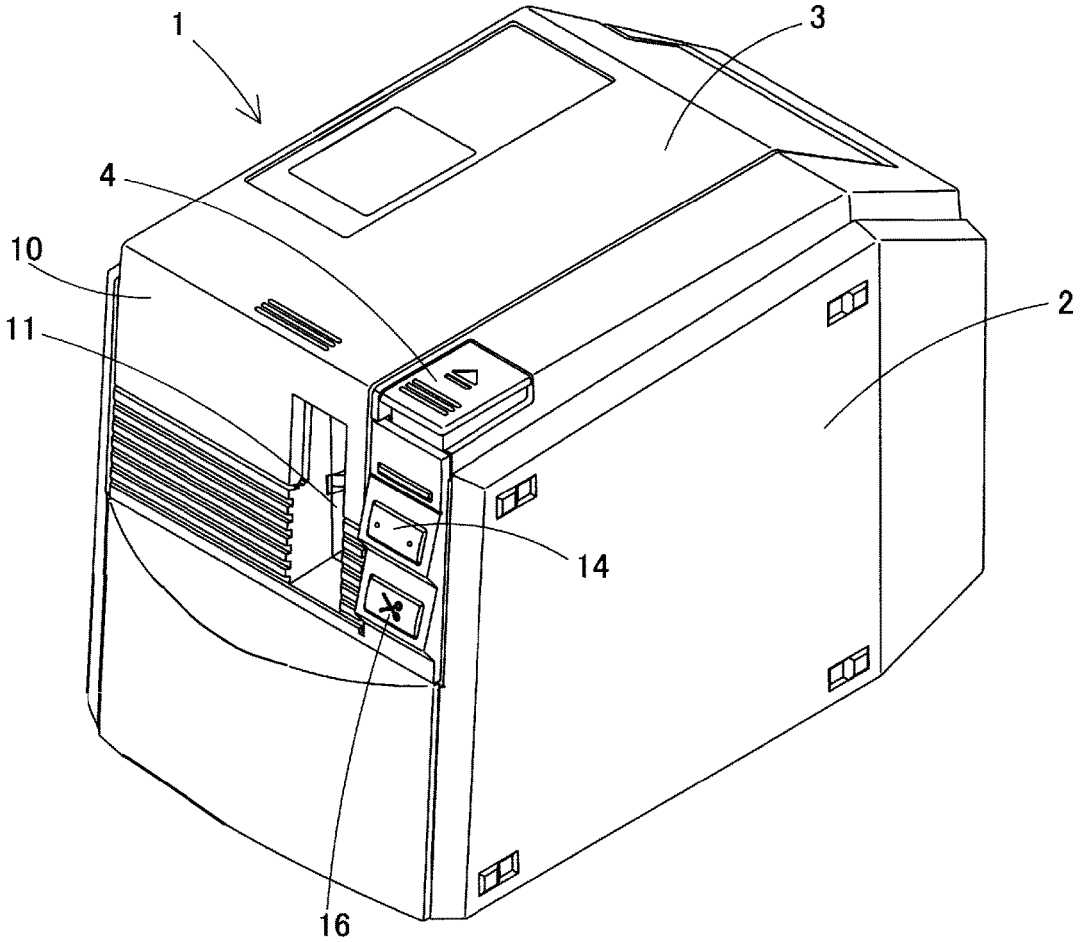

[FIG. 3]
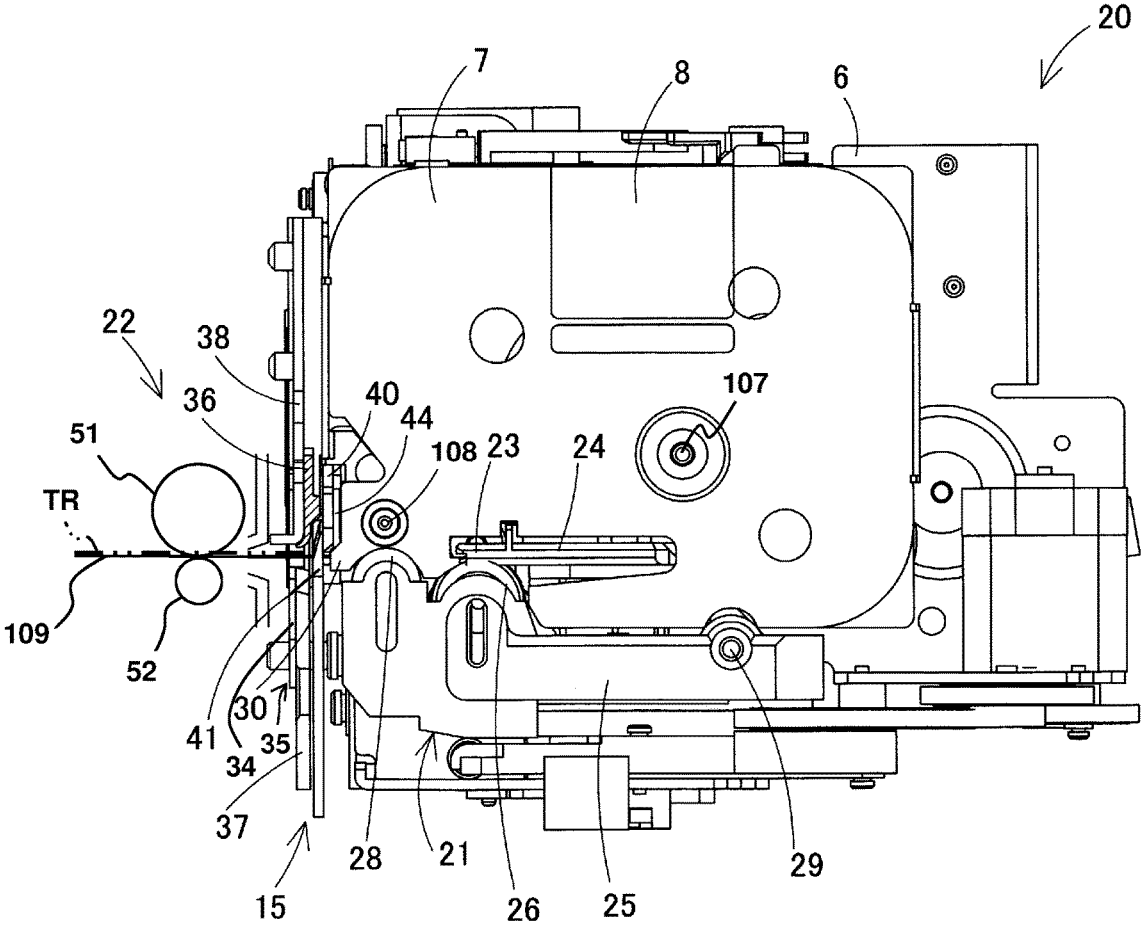

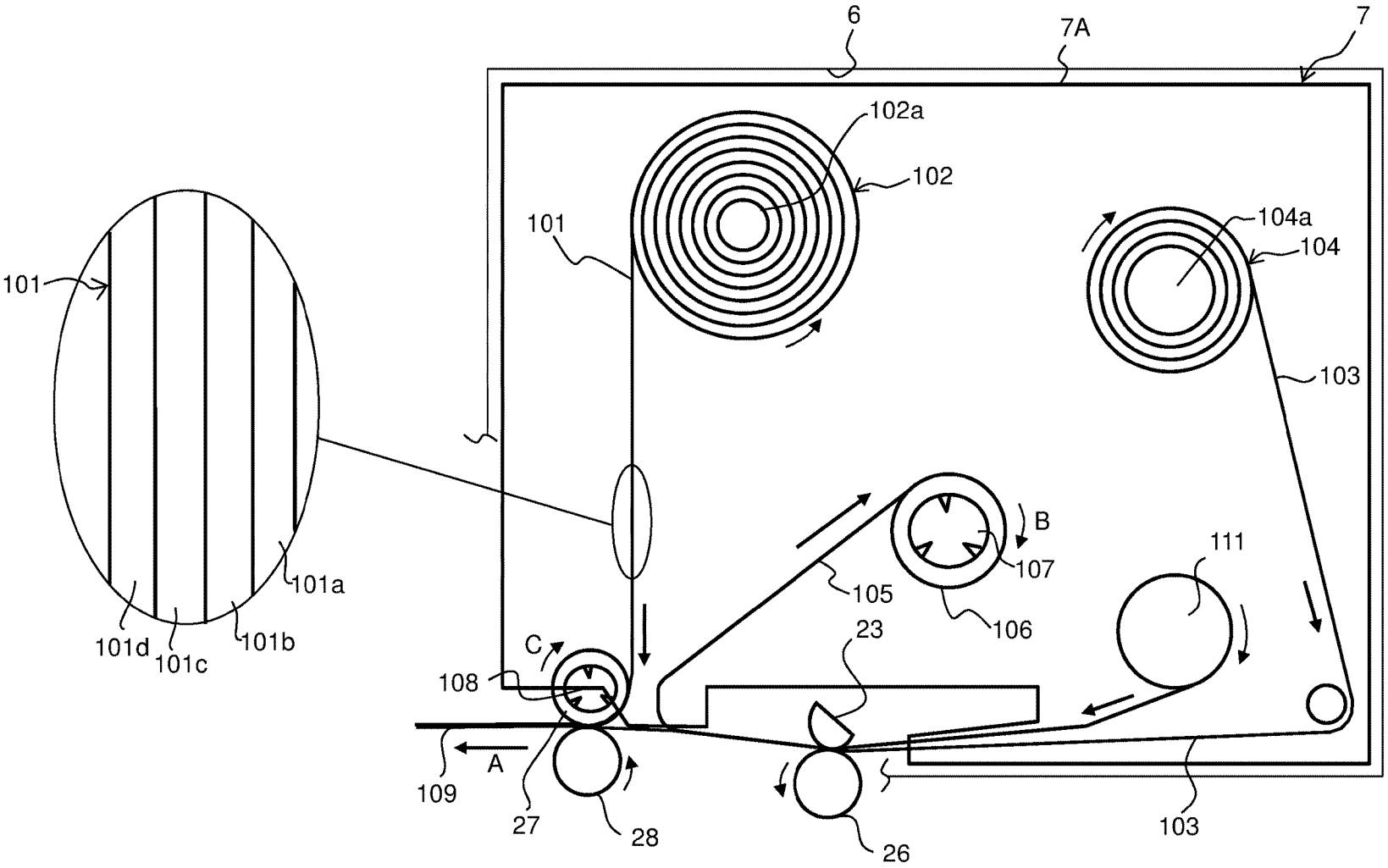
[FIG. 4]

[FIG. 5]
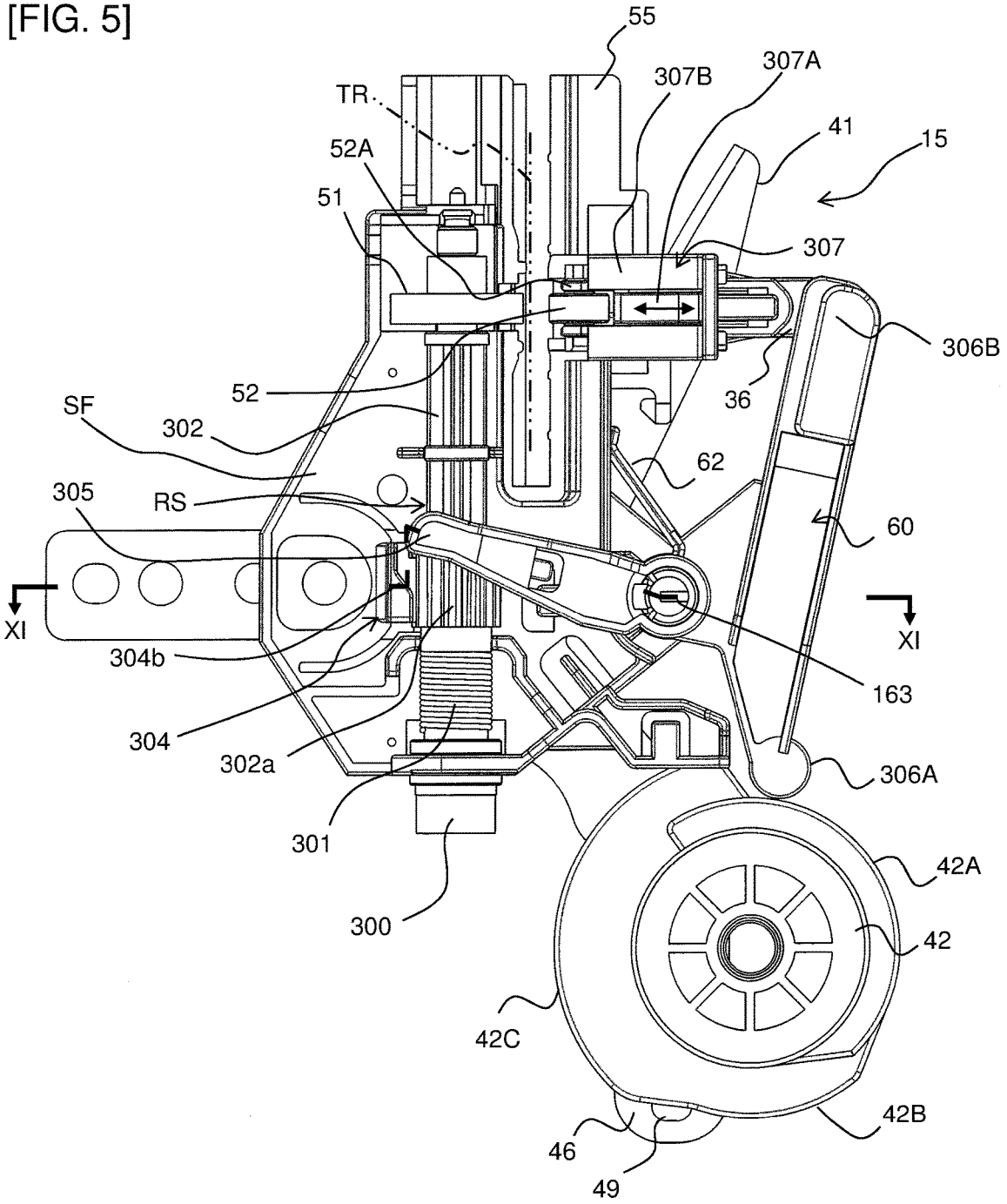

[FIG. 6]
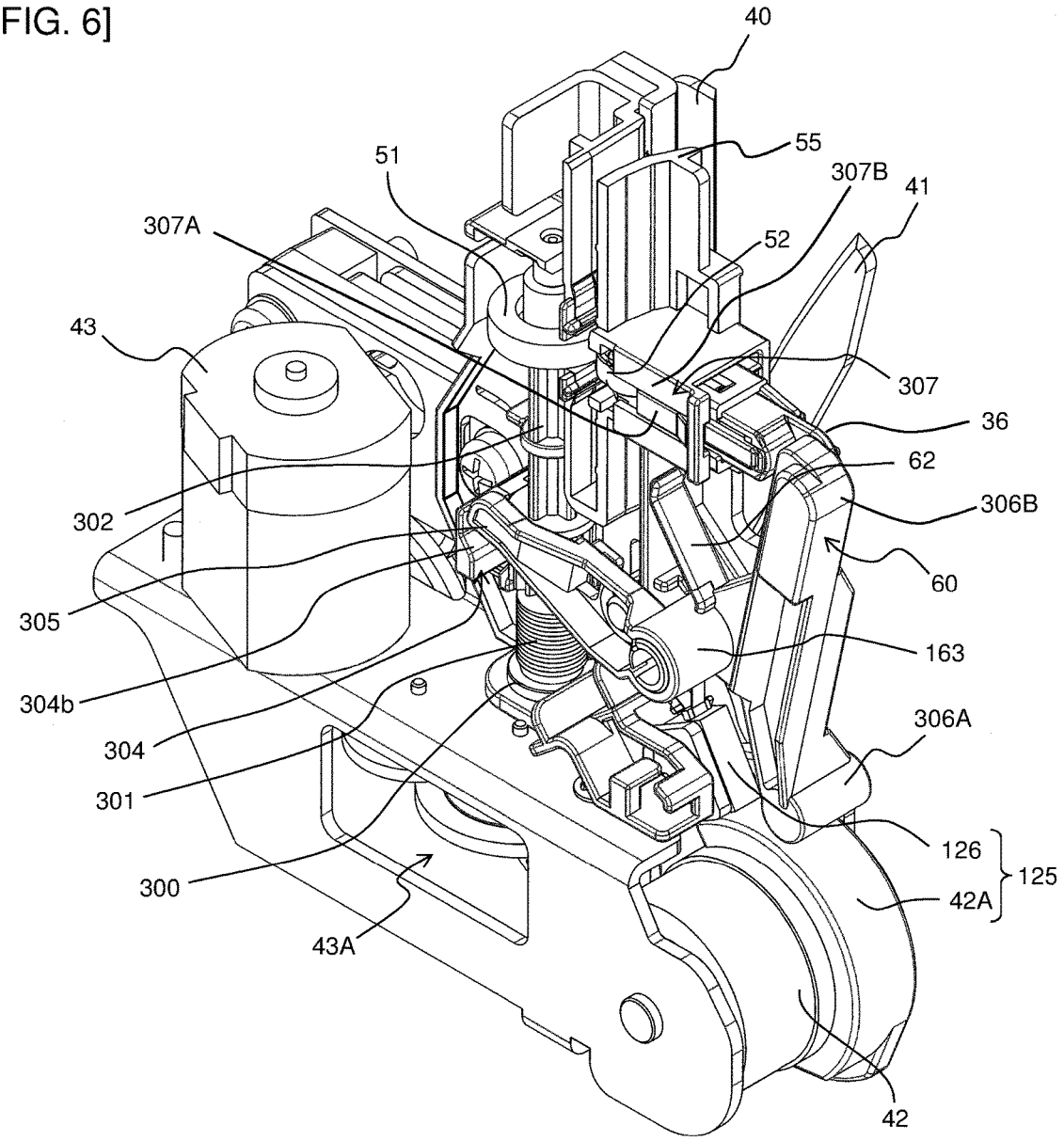

[FIG. 7]
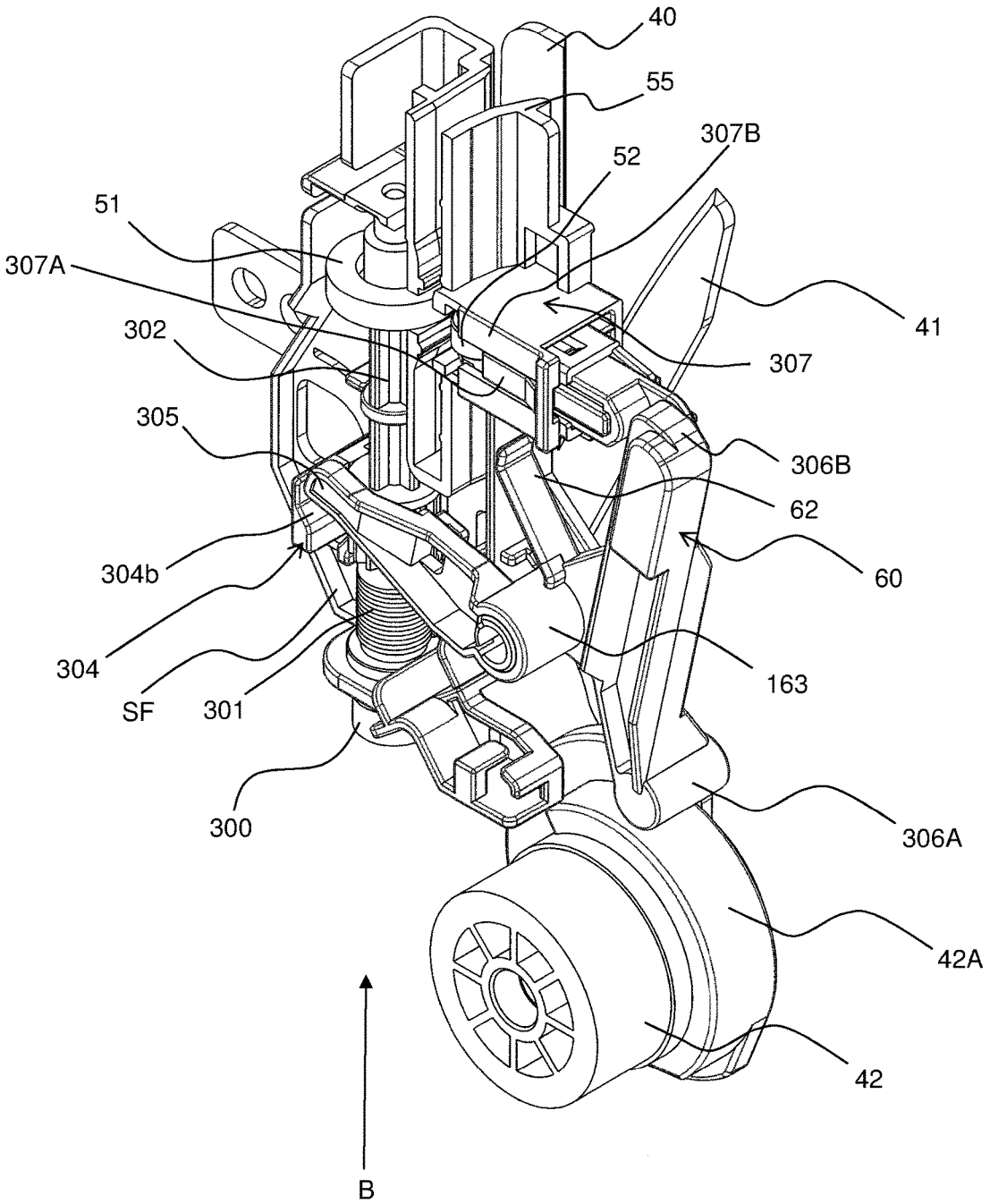

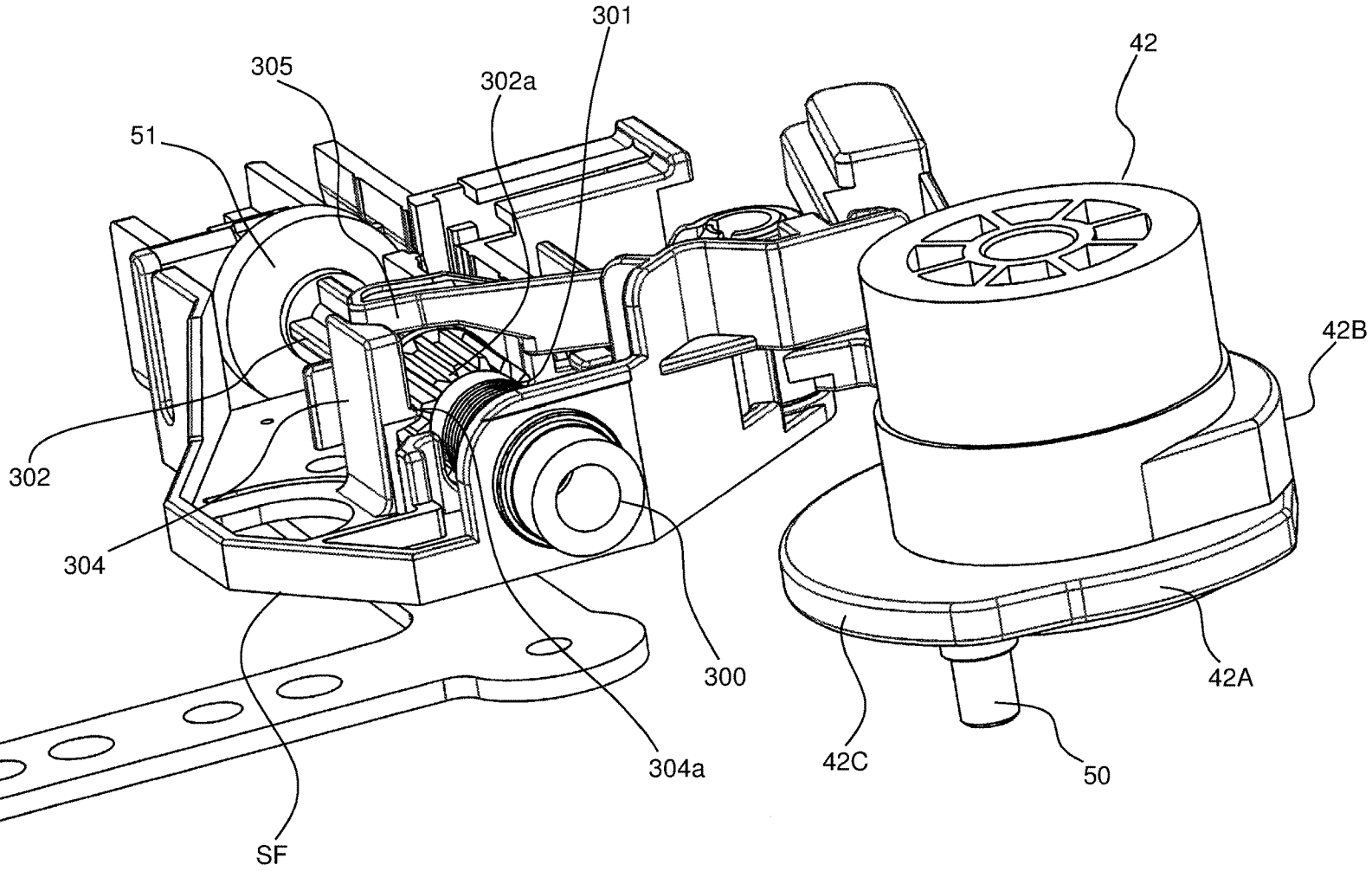
[FIG. 8]

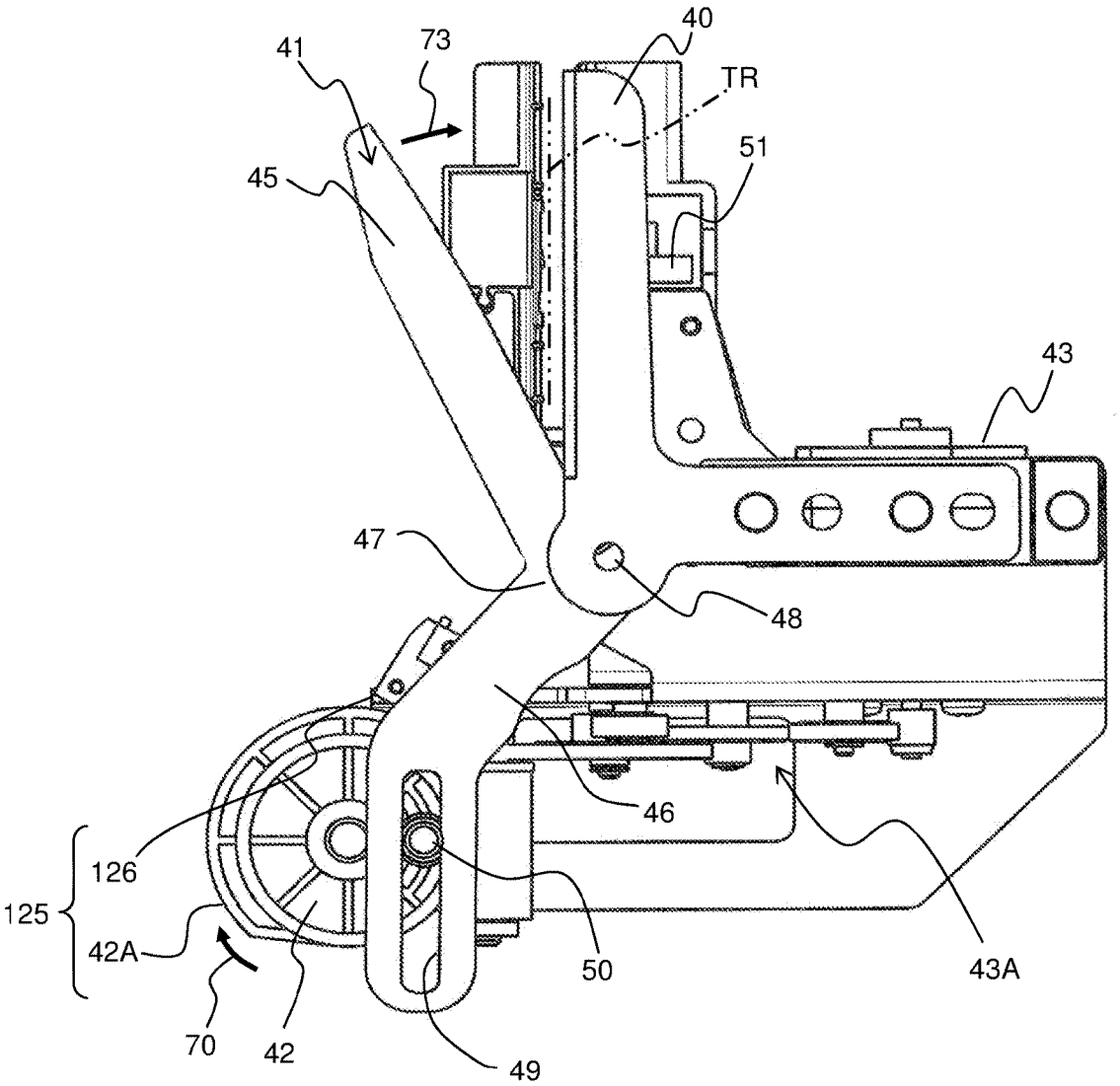
[FIG. 9]

[FIG. 10B]
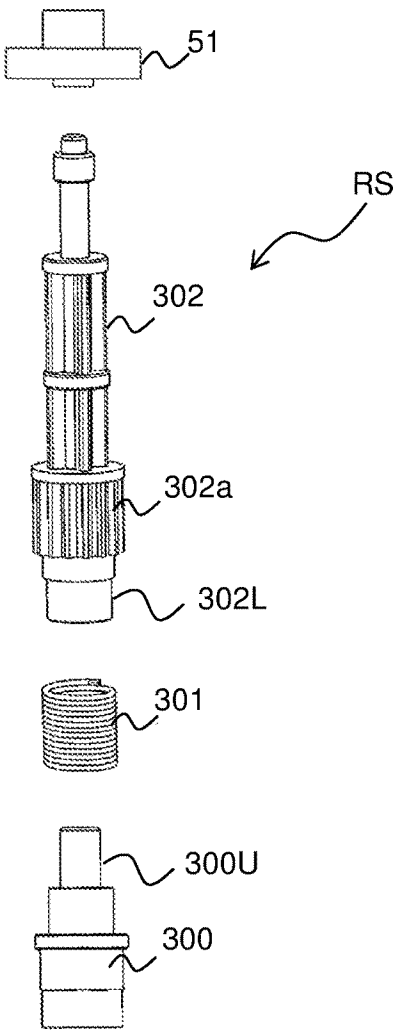
[FIG. 10A]
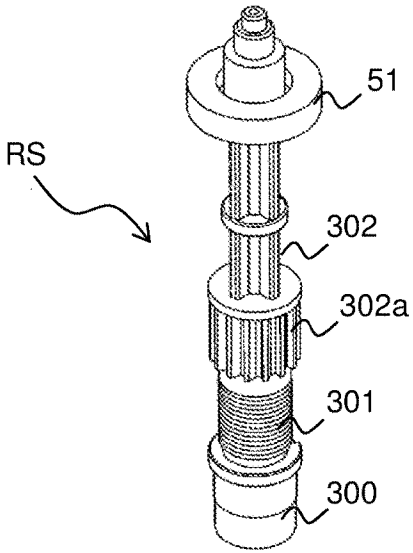

[FIG. 11A]
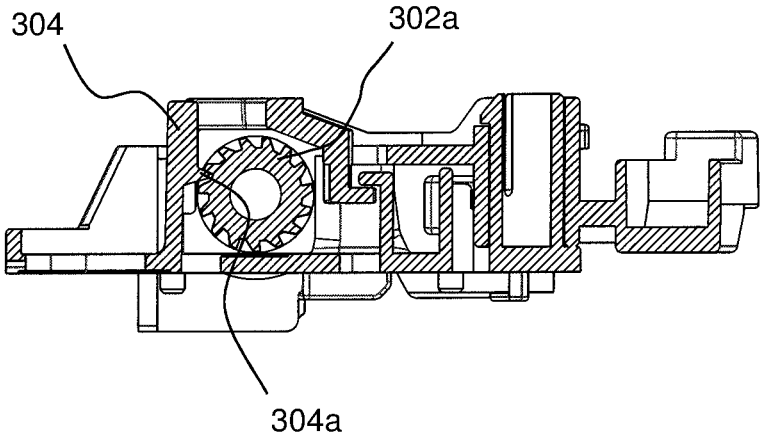
[FIG. 11B]
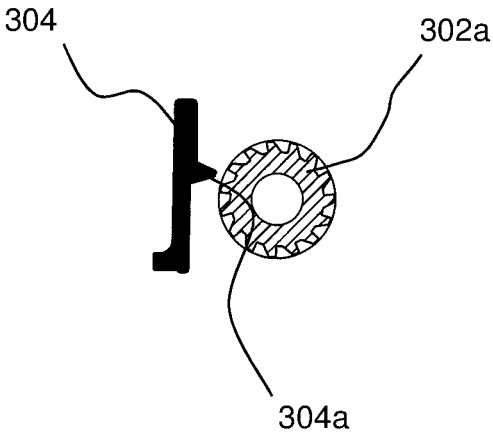

[FIG. 12]
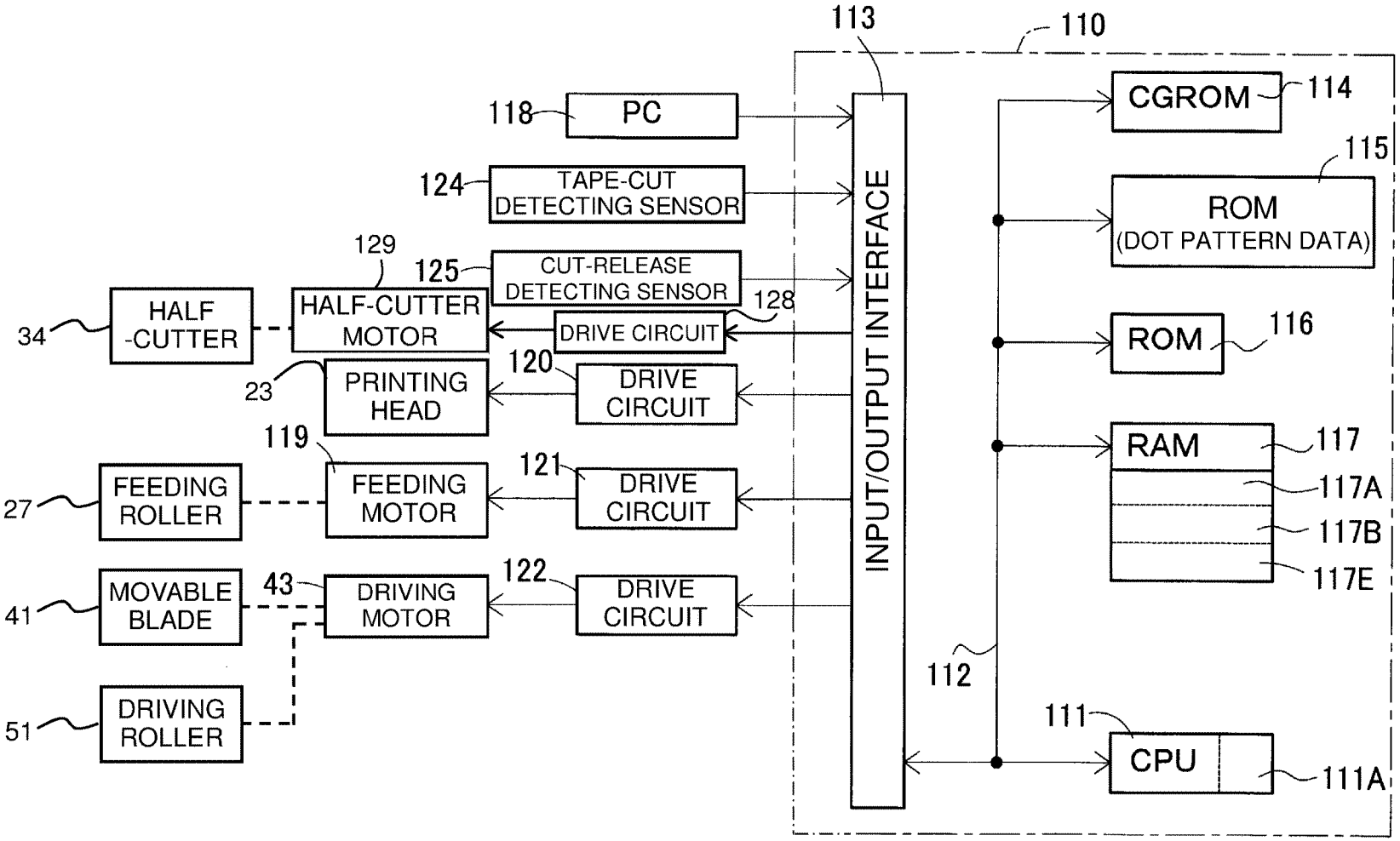

[FIG. 13A]
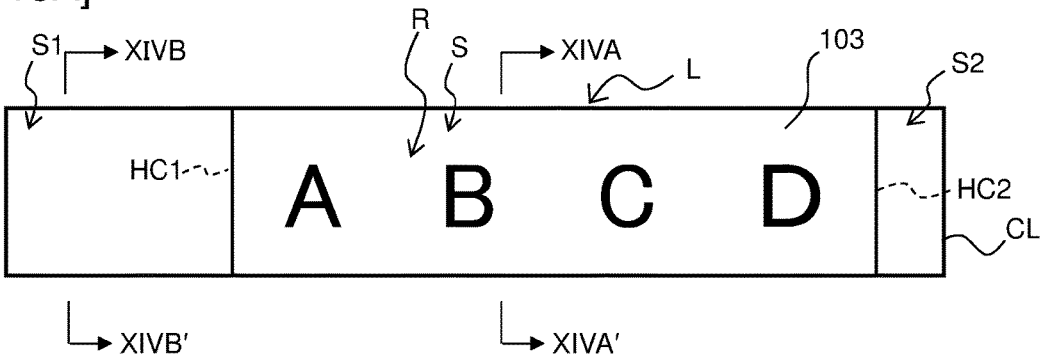
[FIG. 13B]
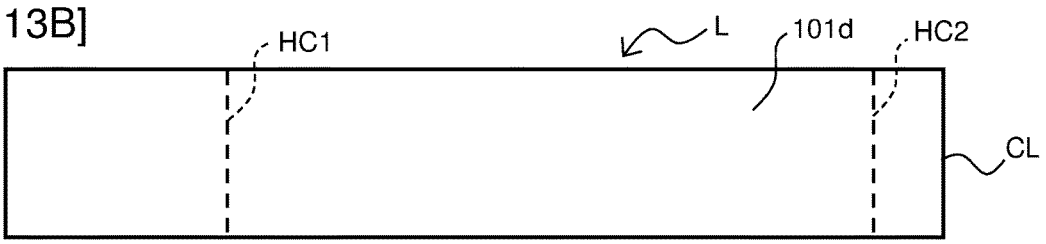
[FIG. 13C]
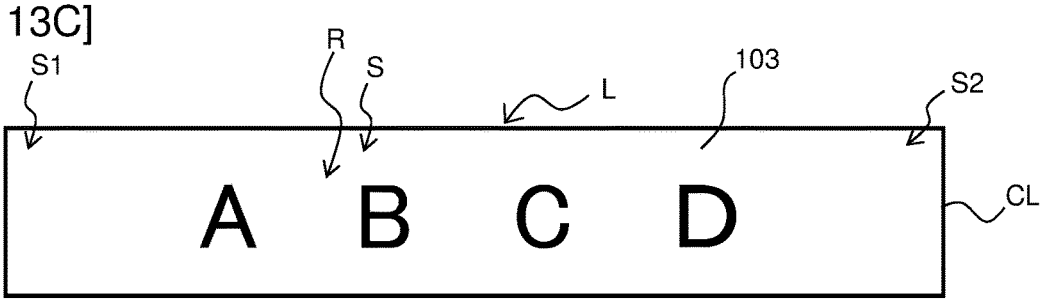
[FIG. 13D]
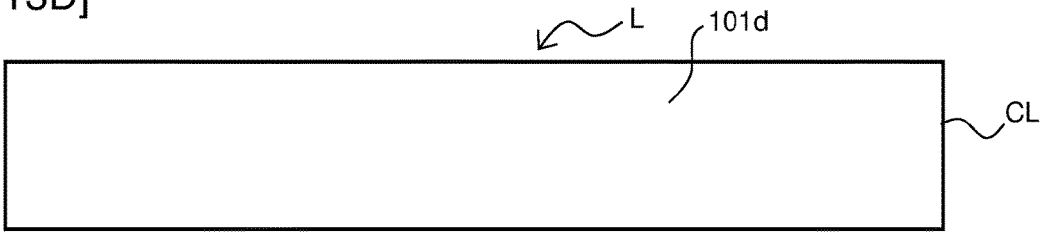

[FIG. 14A]
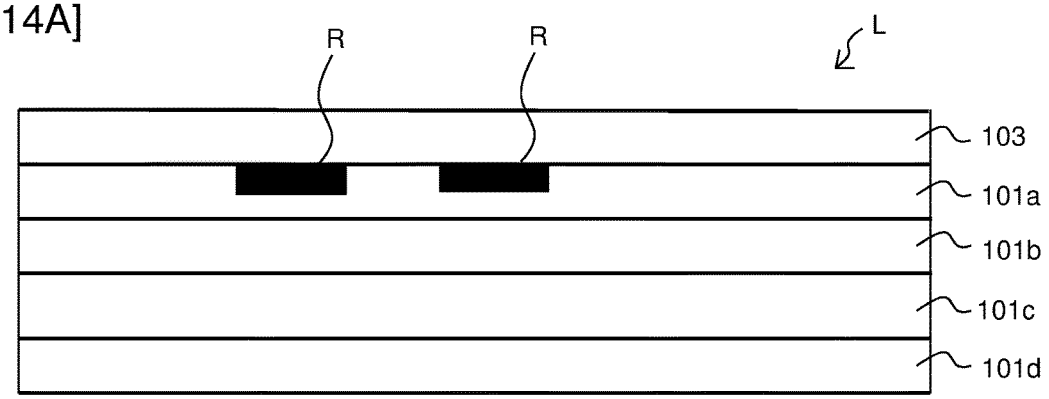
[FIG. 14B]
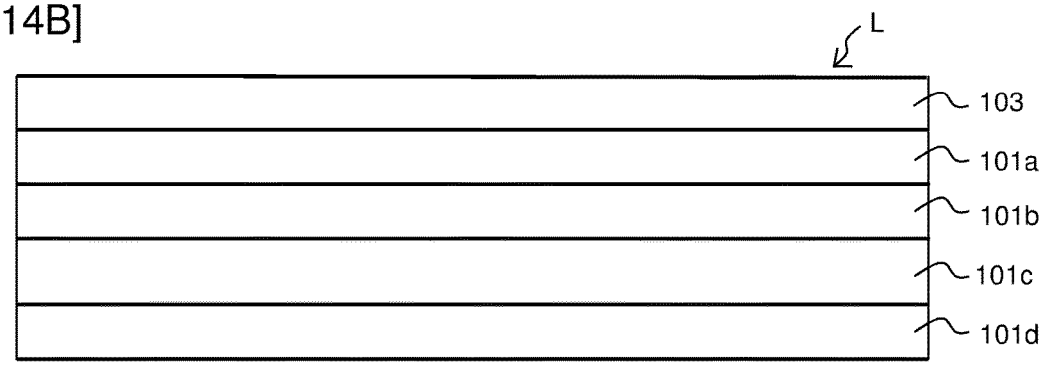

[FIG. 15]
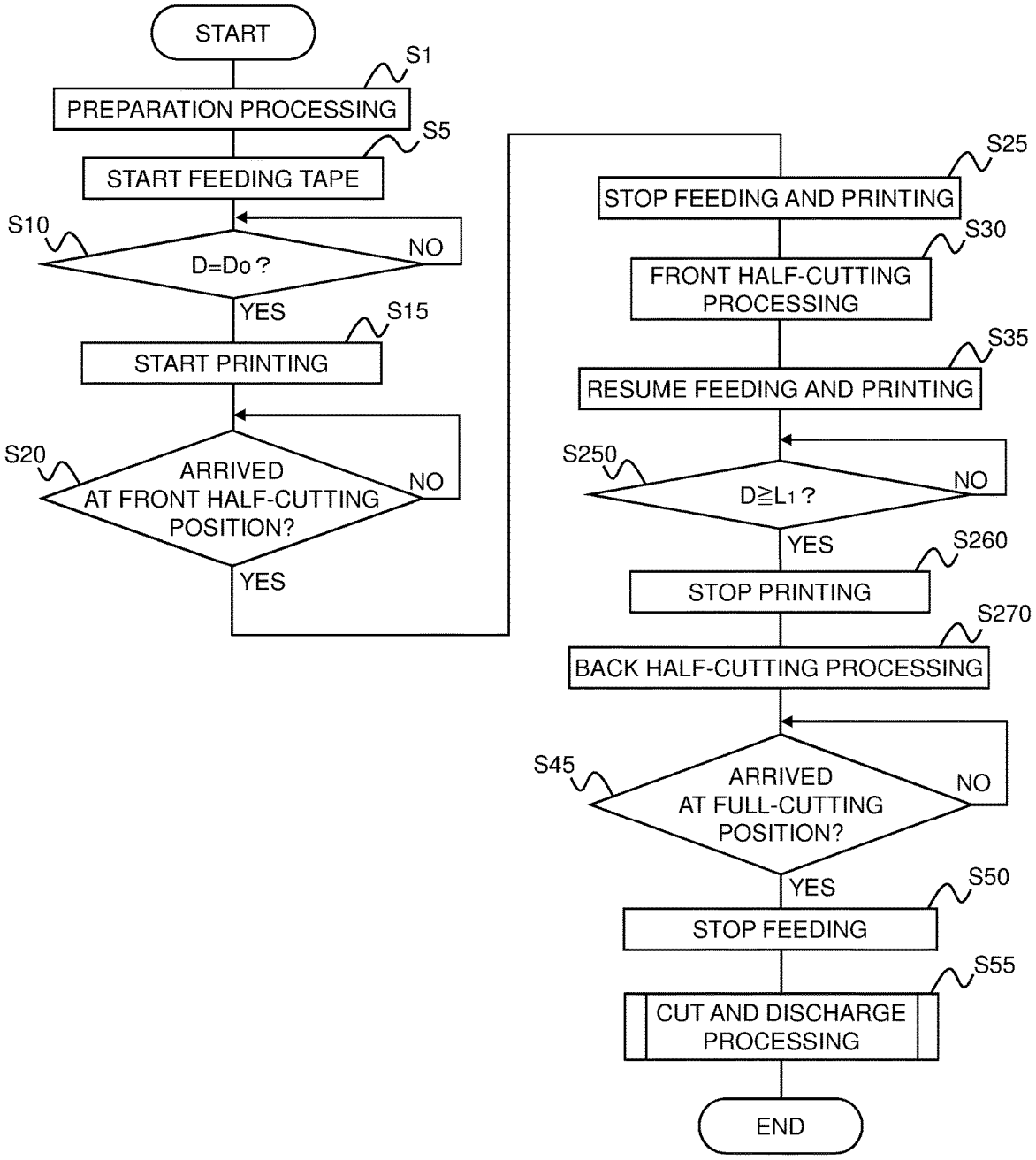

[FIG. 16]
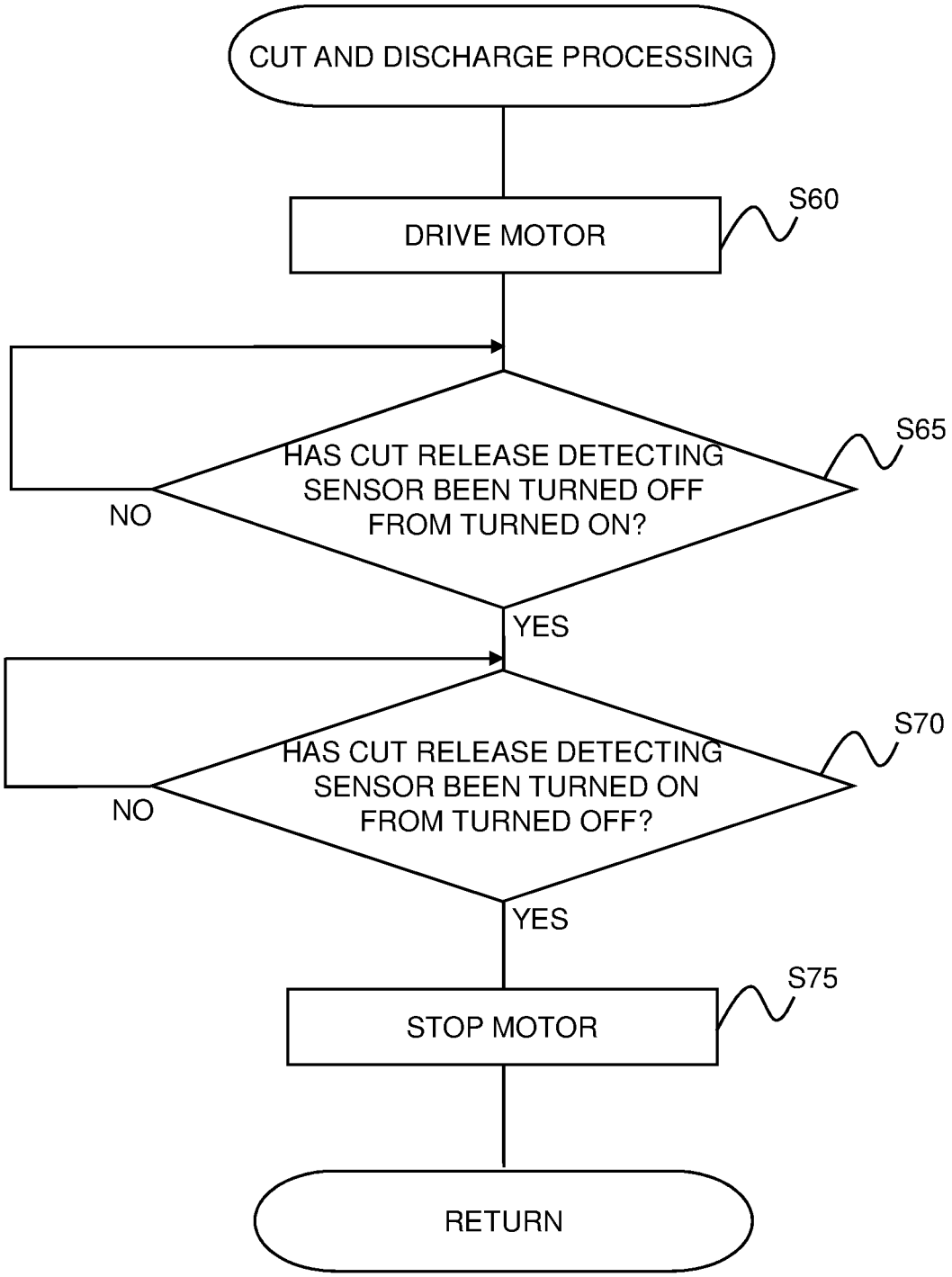

[FIG. 17]
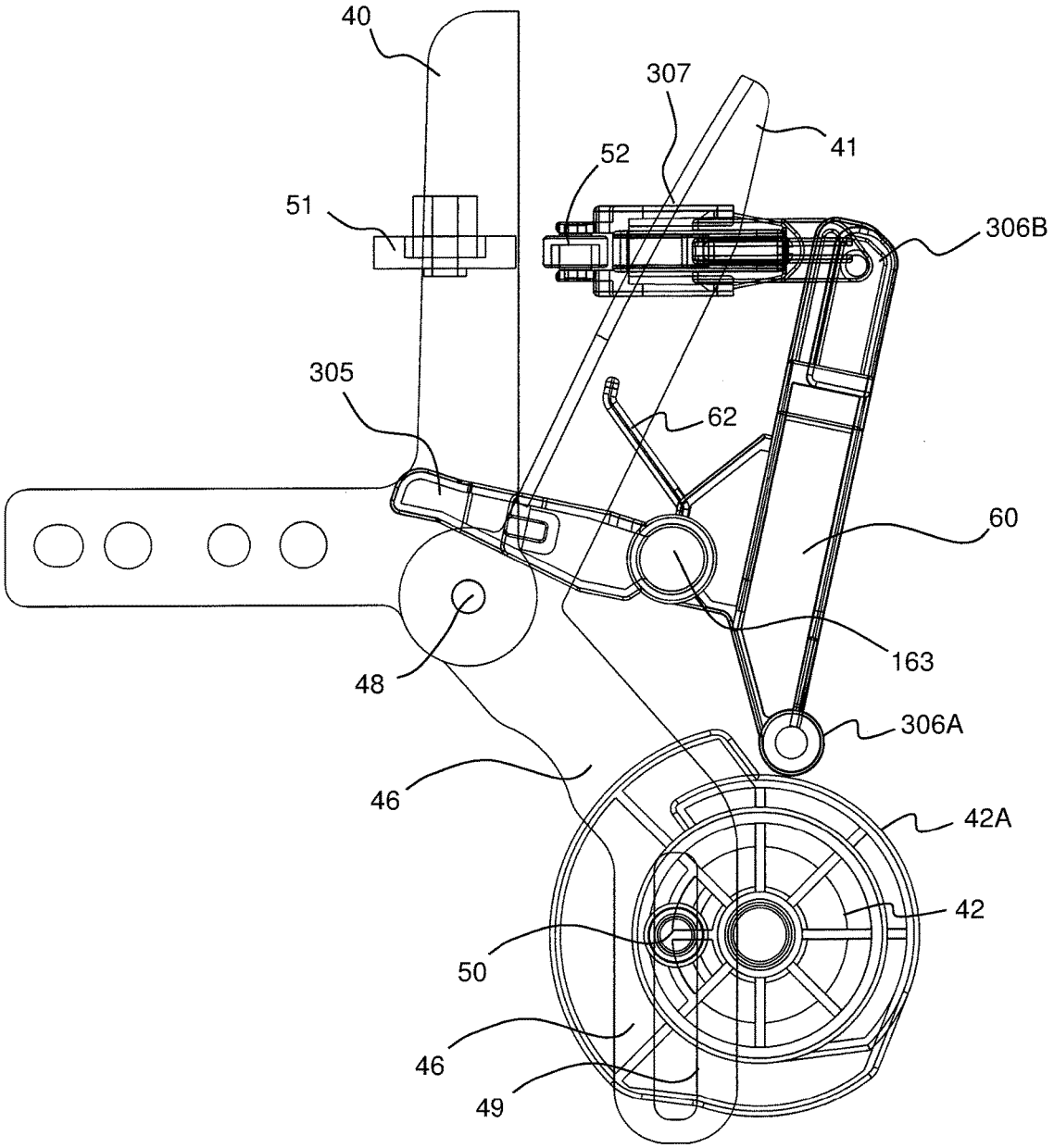

[FIG. 18]
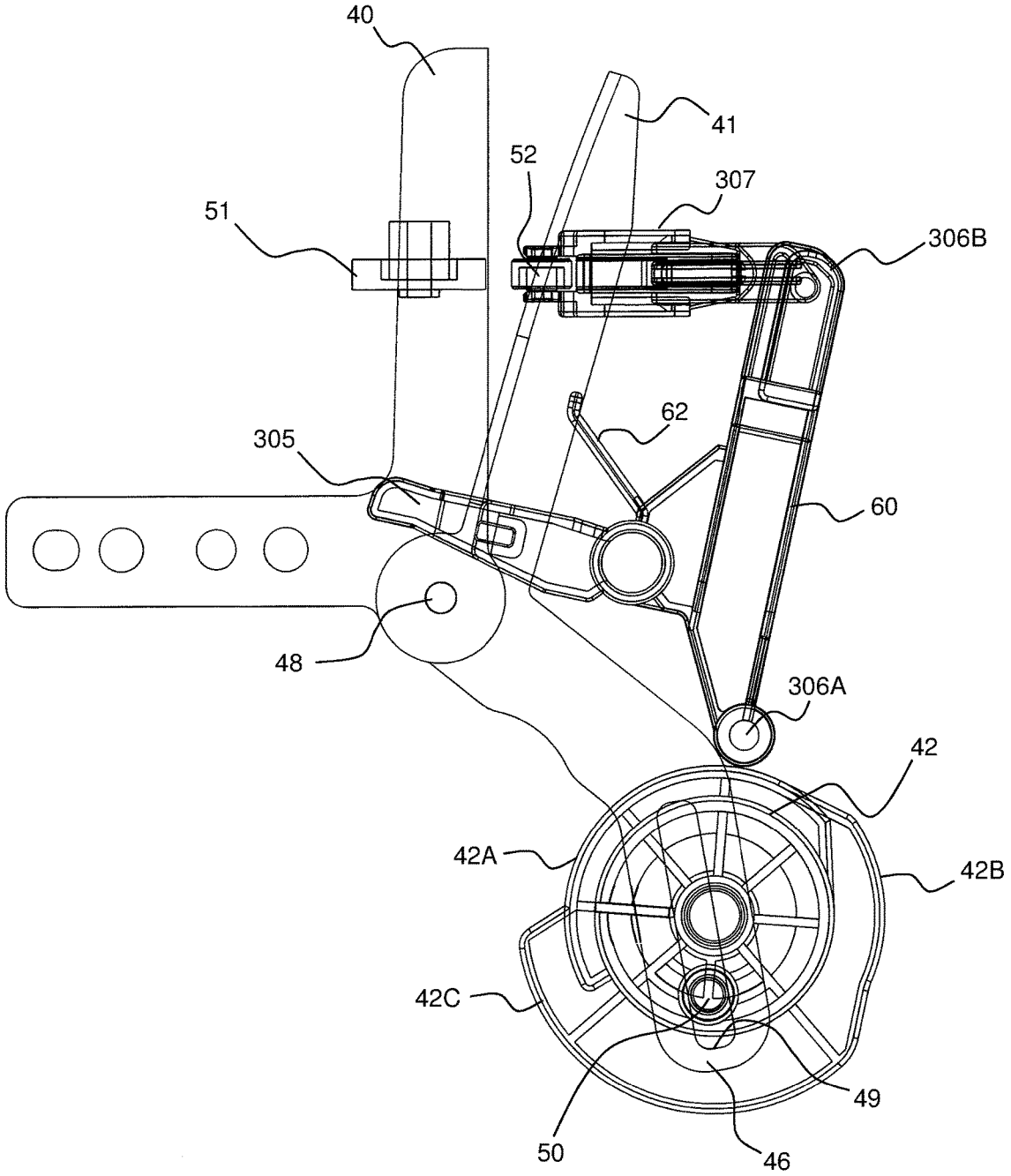

[FIG. 19]
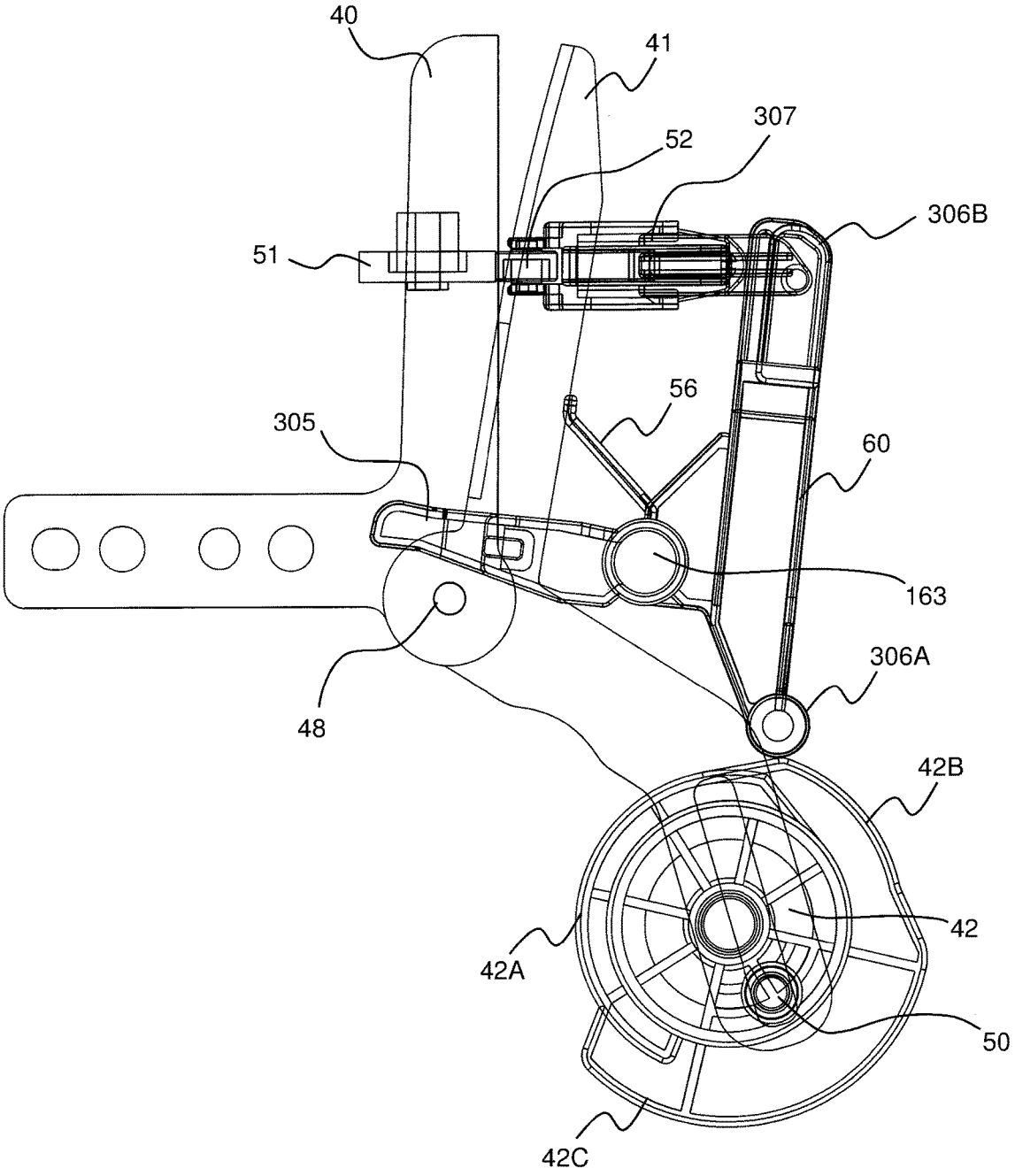

[FIG. 20]
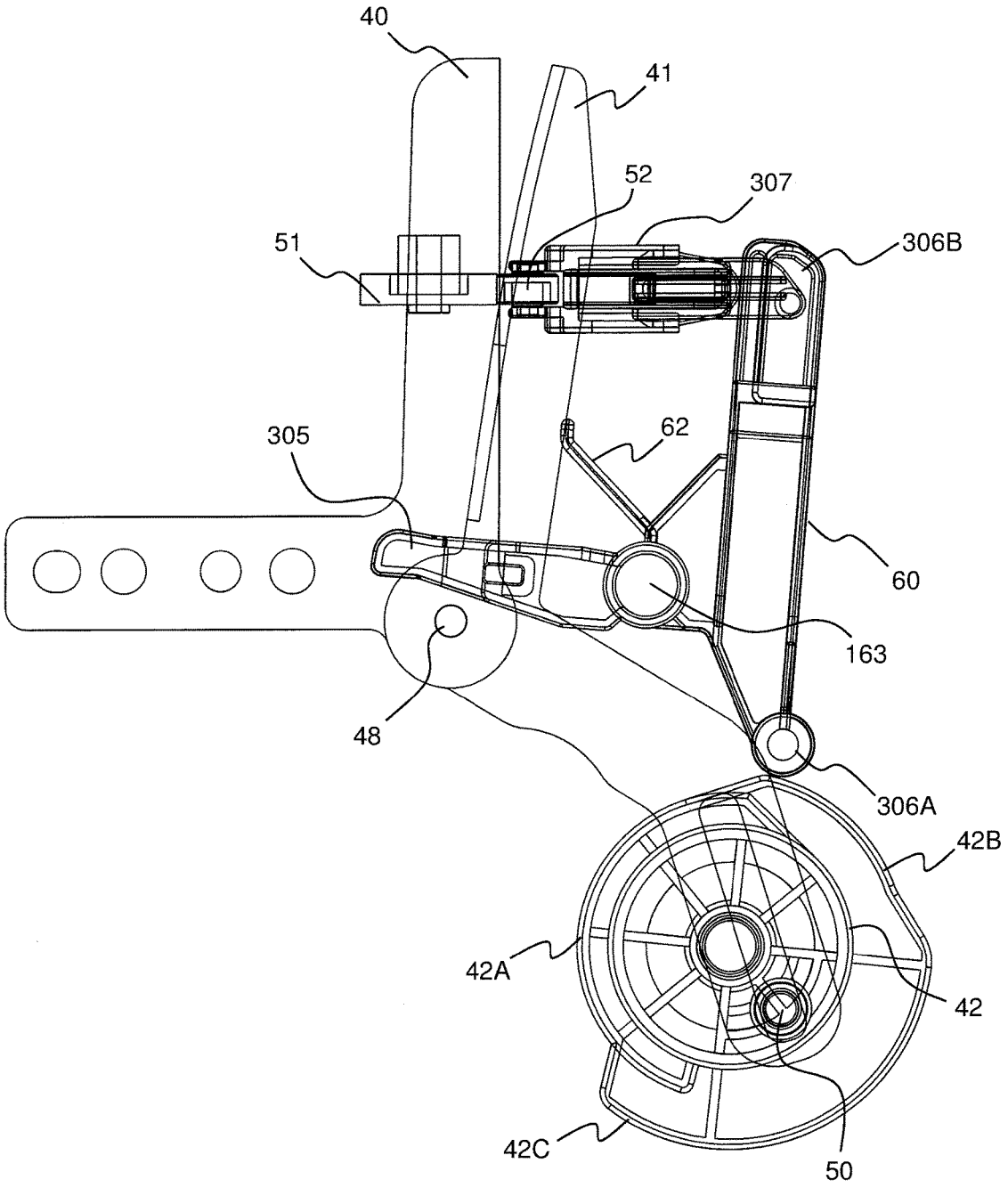

[FIG. 21]
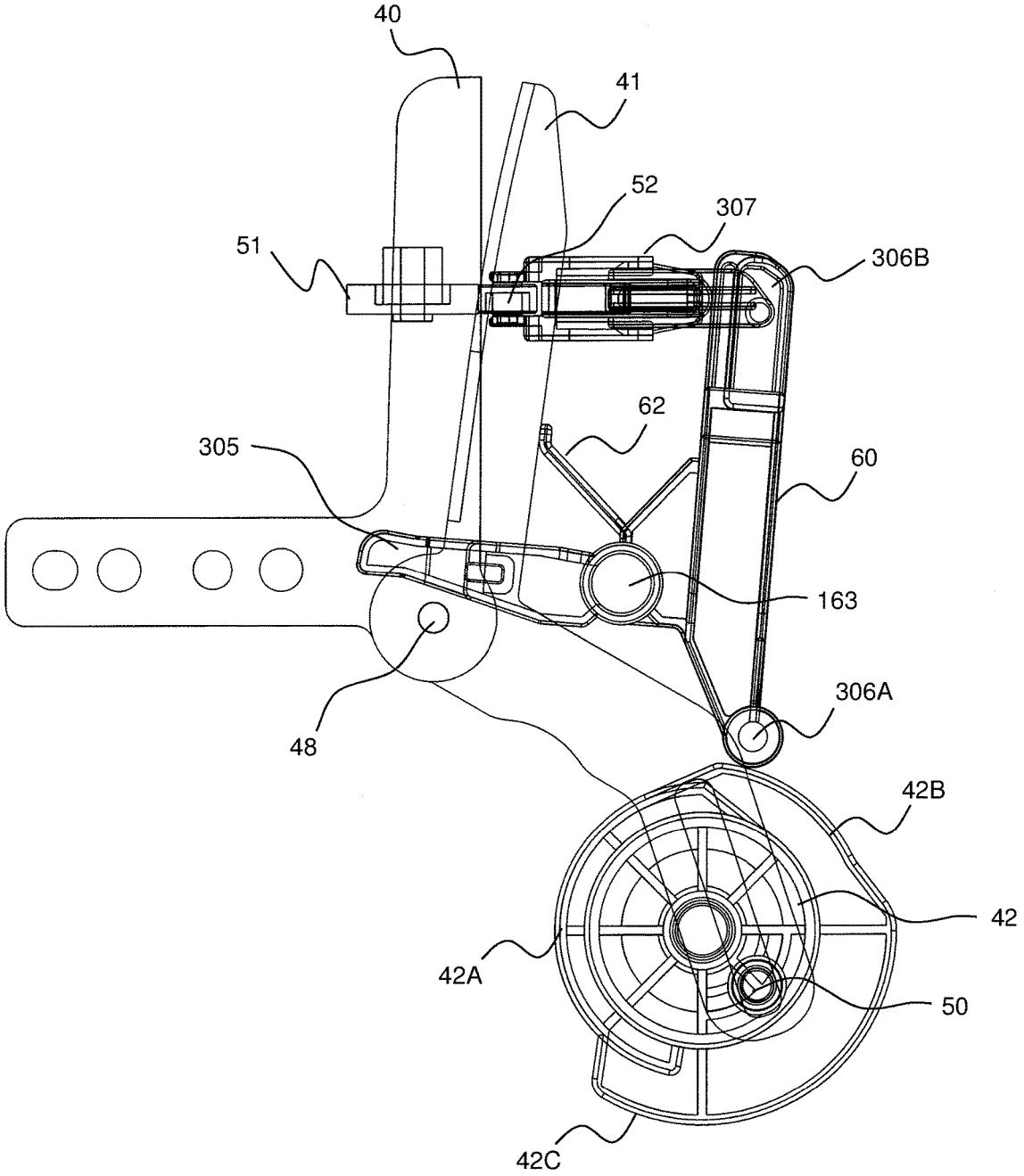

[FIG. 22]
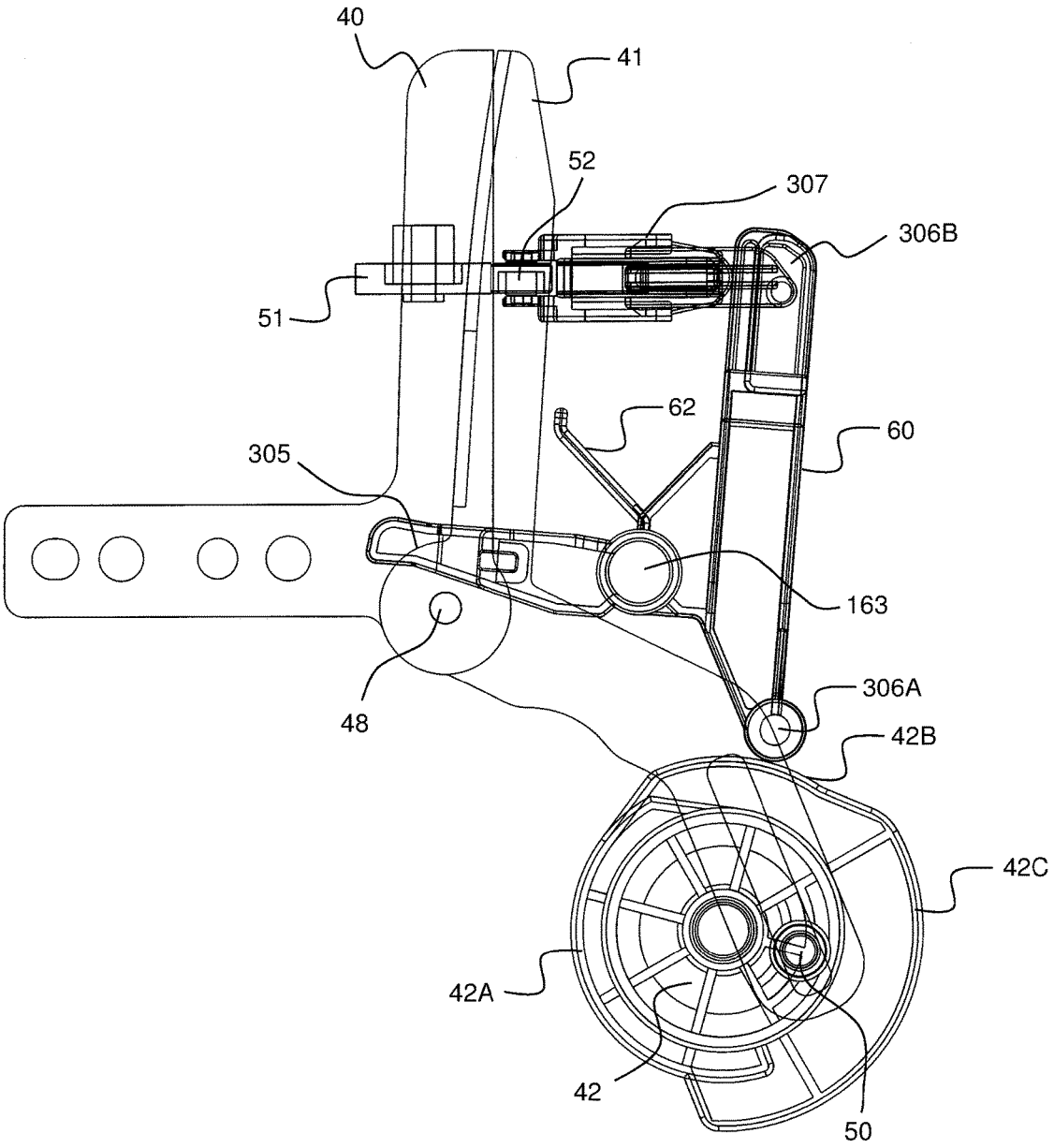

[FIG. 23]
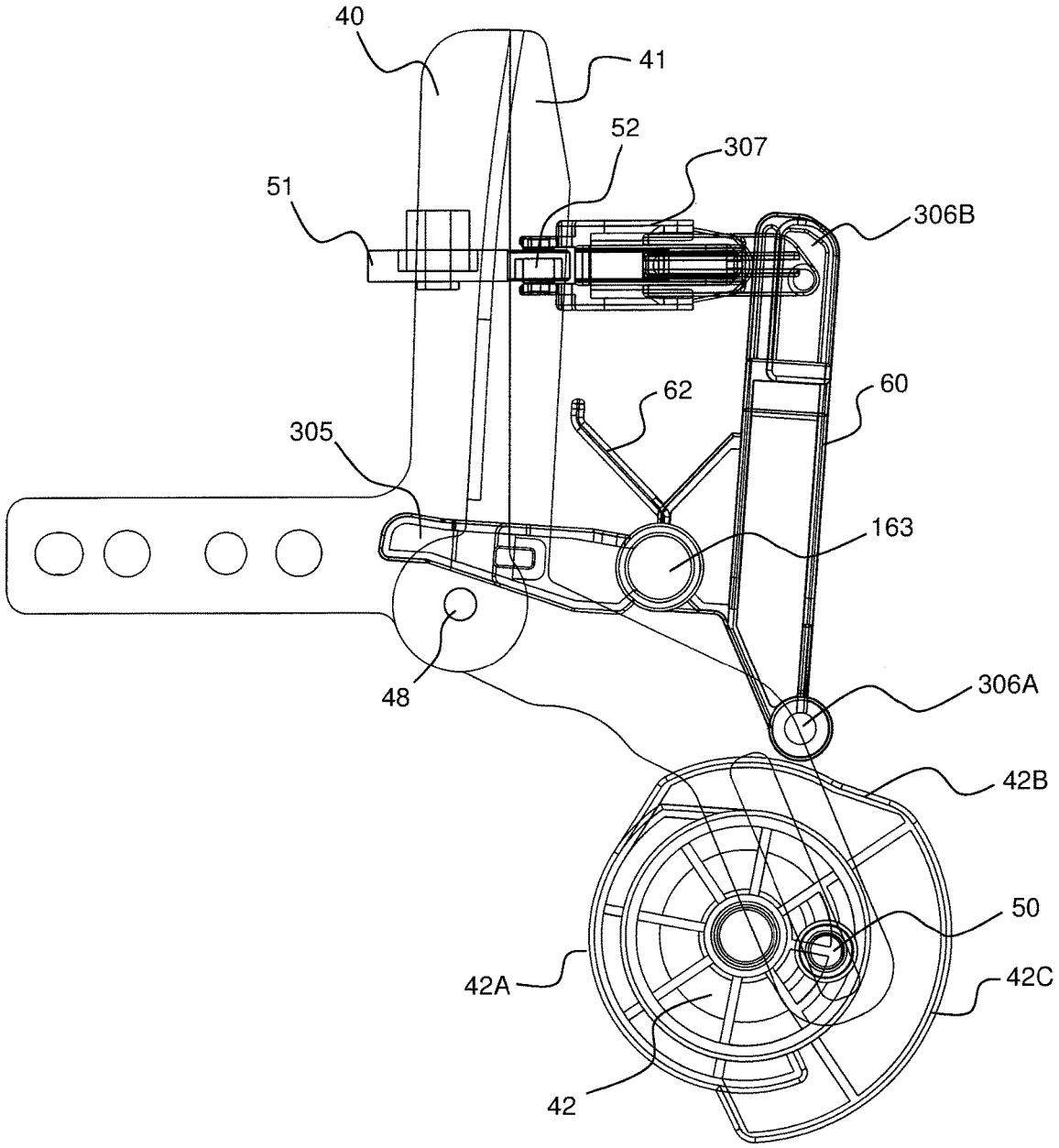

[FIG. 24]
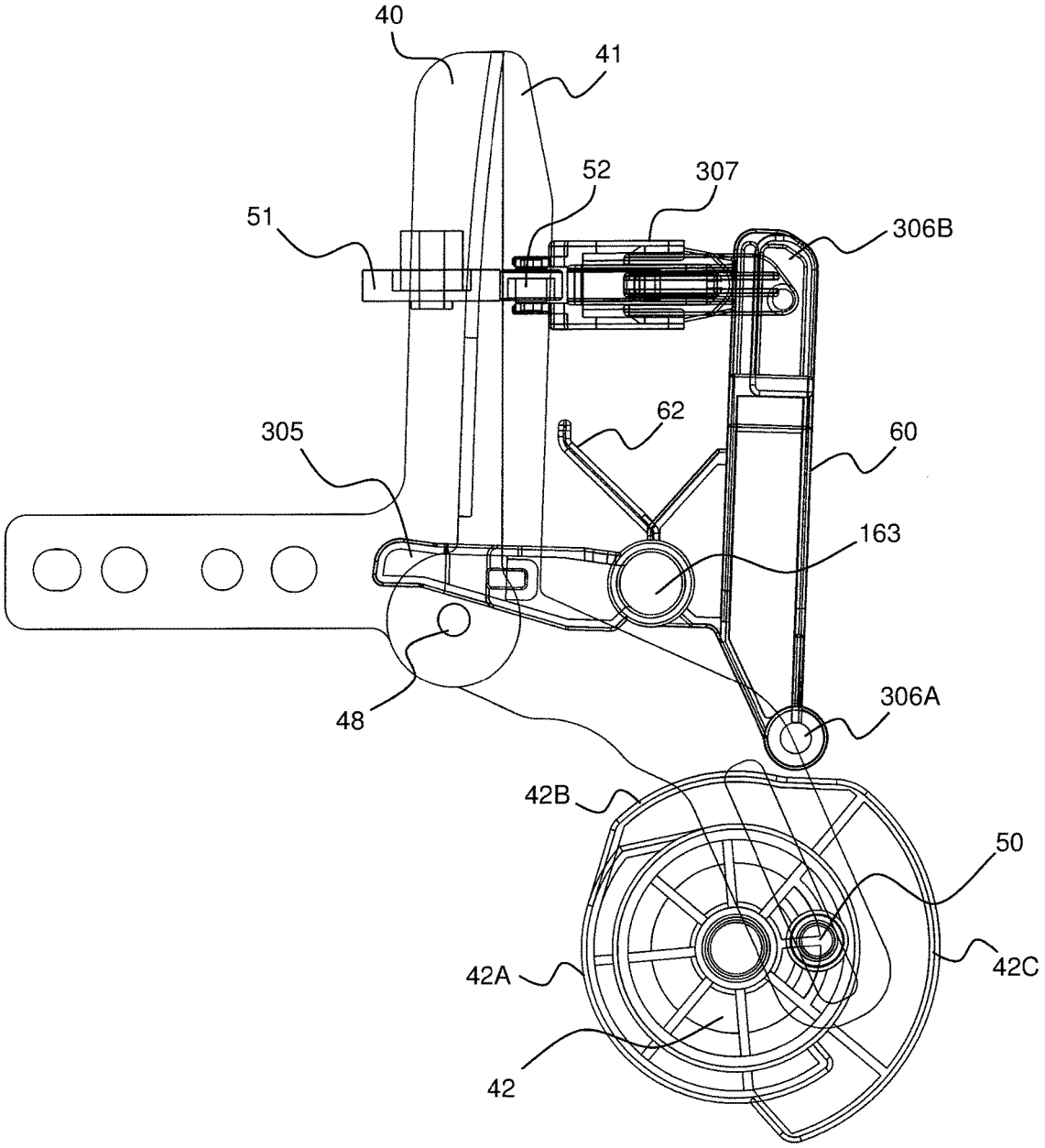

[FIG. 25]
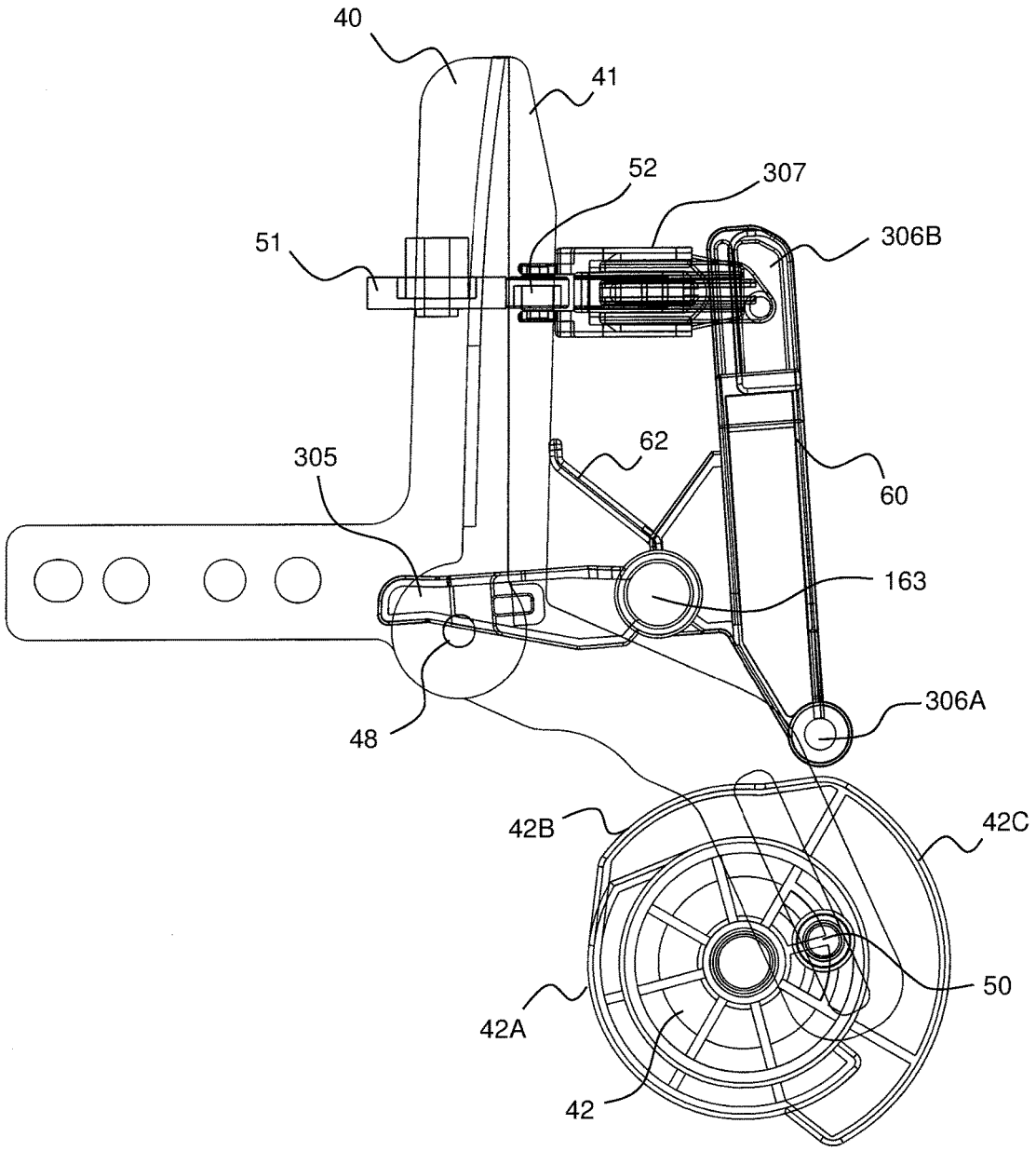

[FIG. 26]
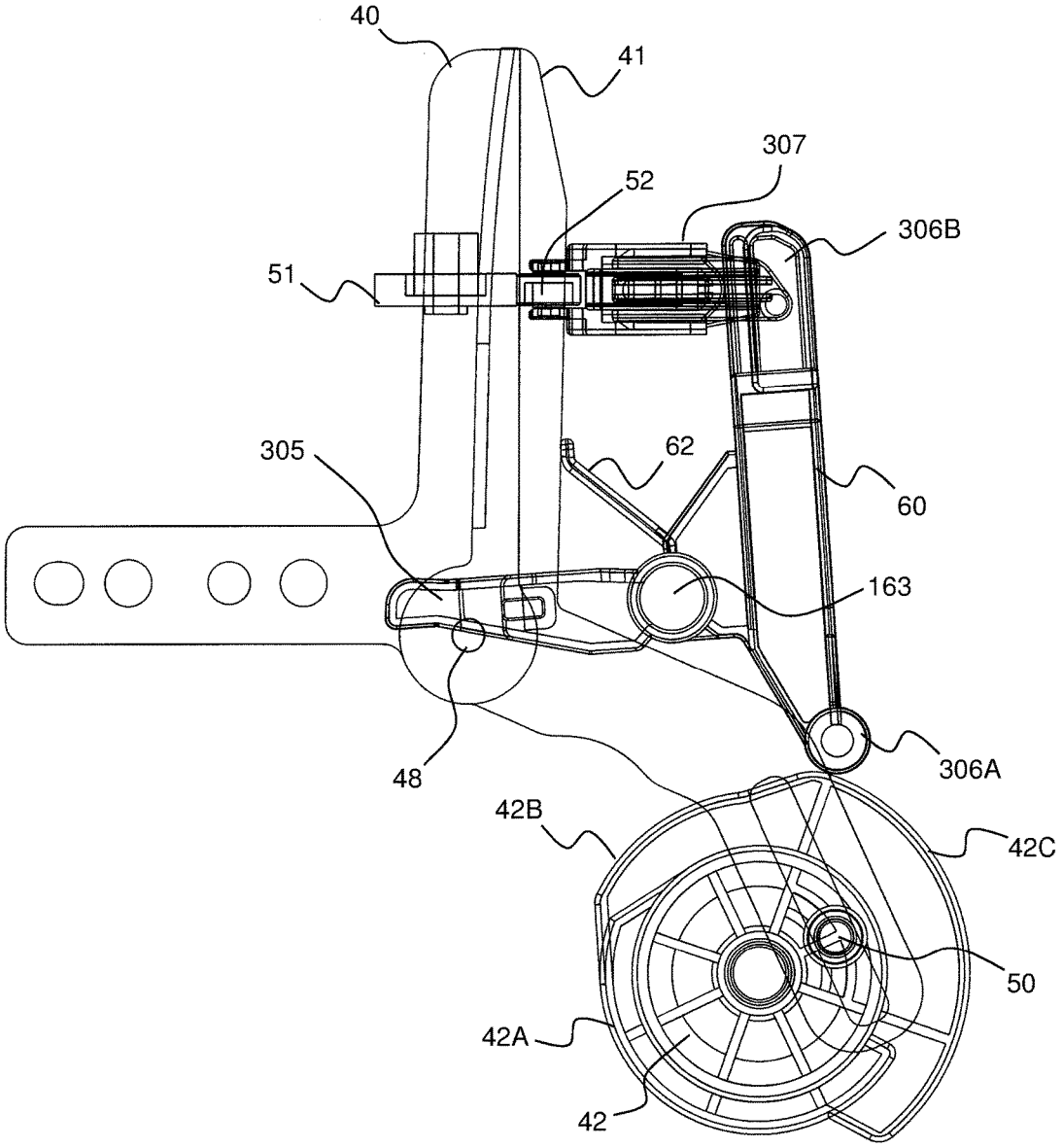

[FIG. 27]
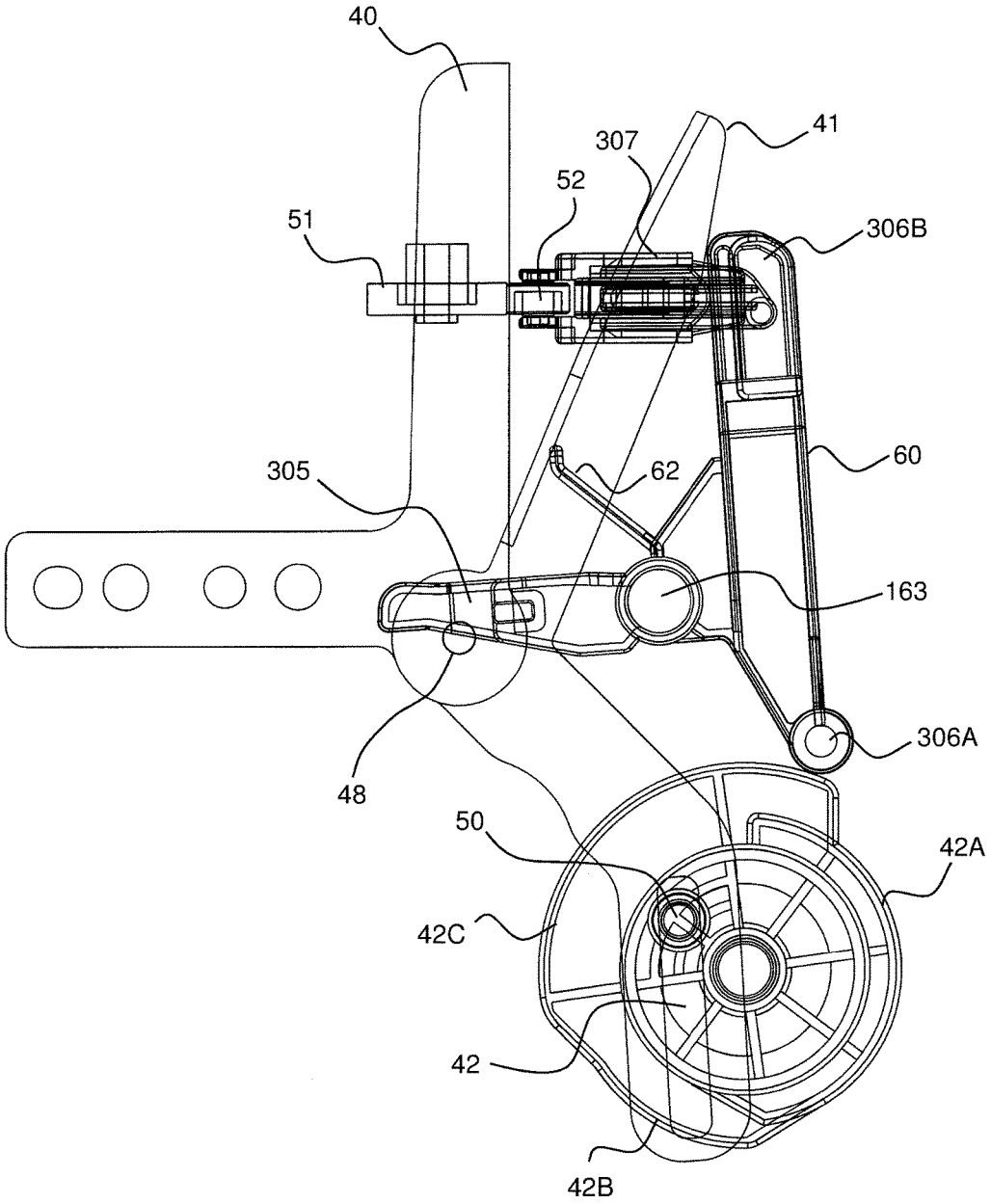

[FIG. 28]
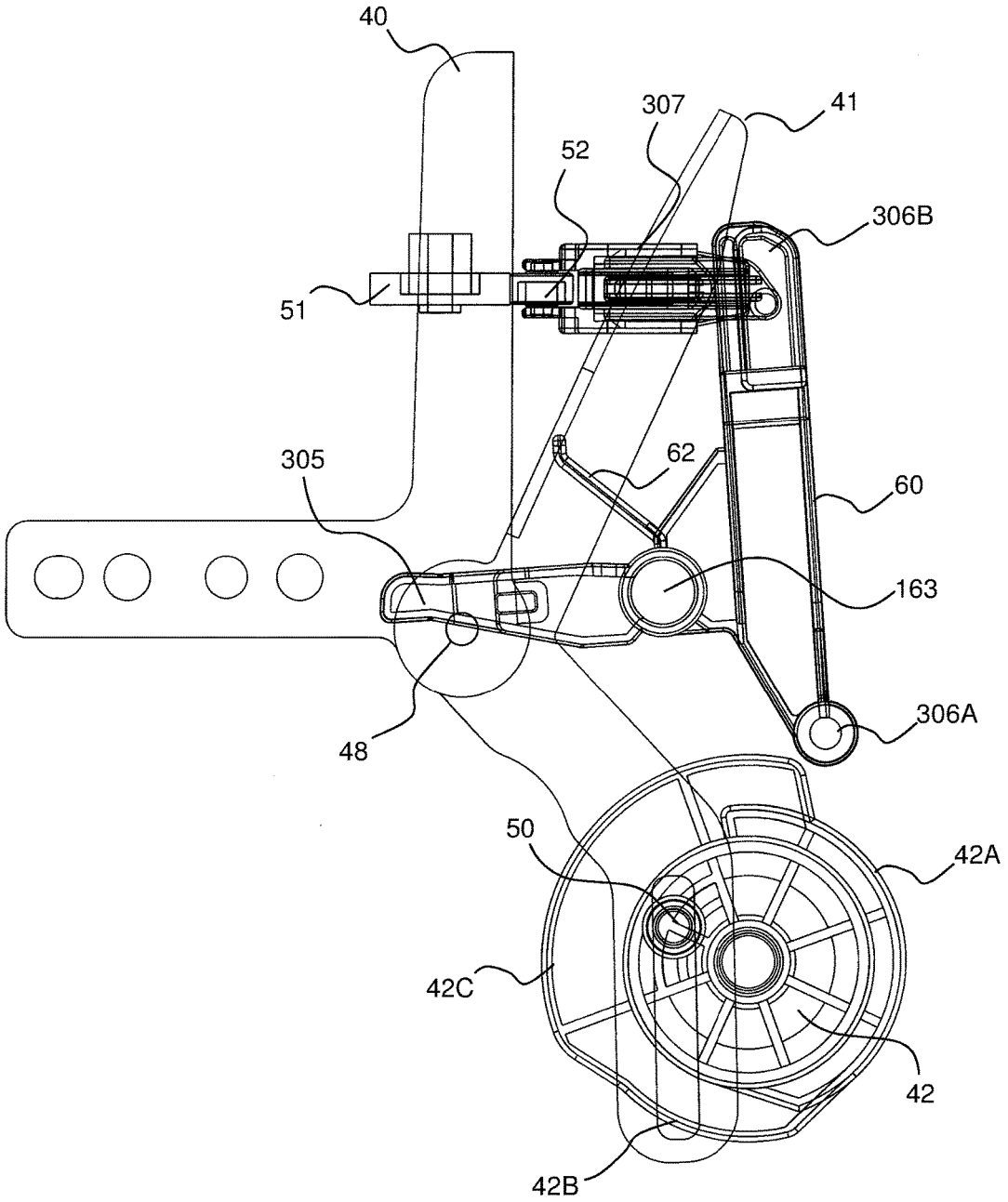

[FIG. 29A]
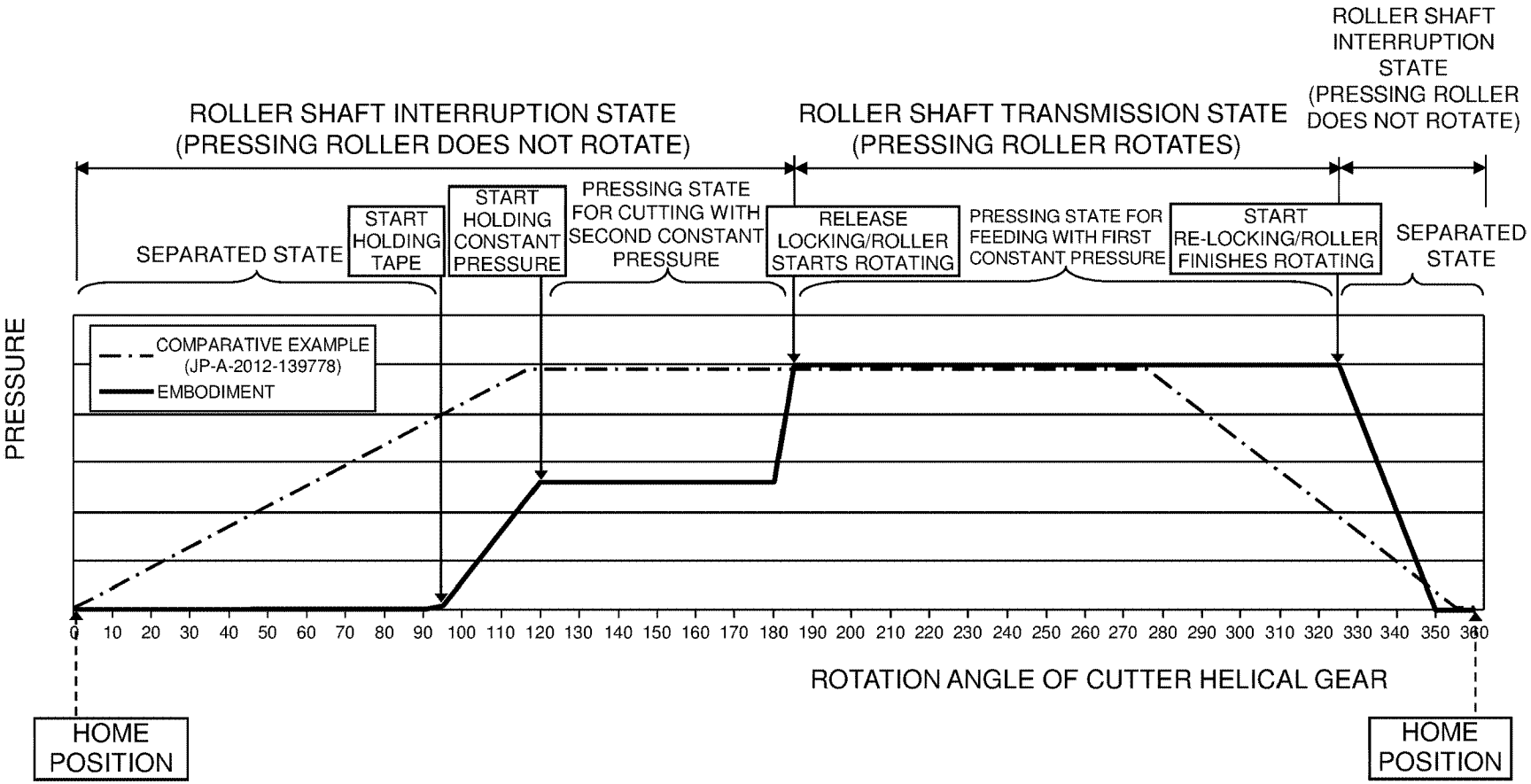

[FIG. 29B]
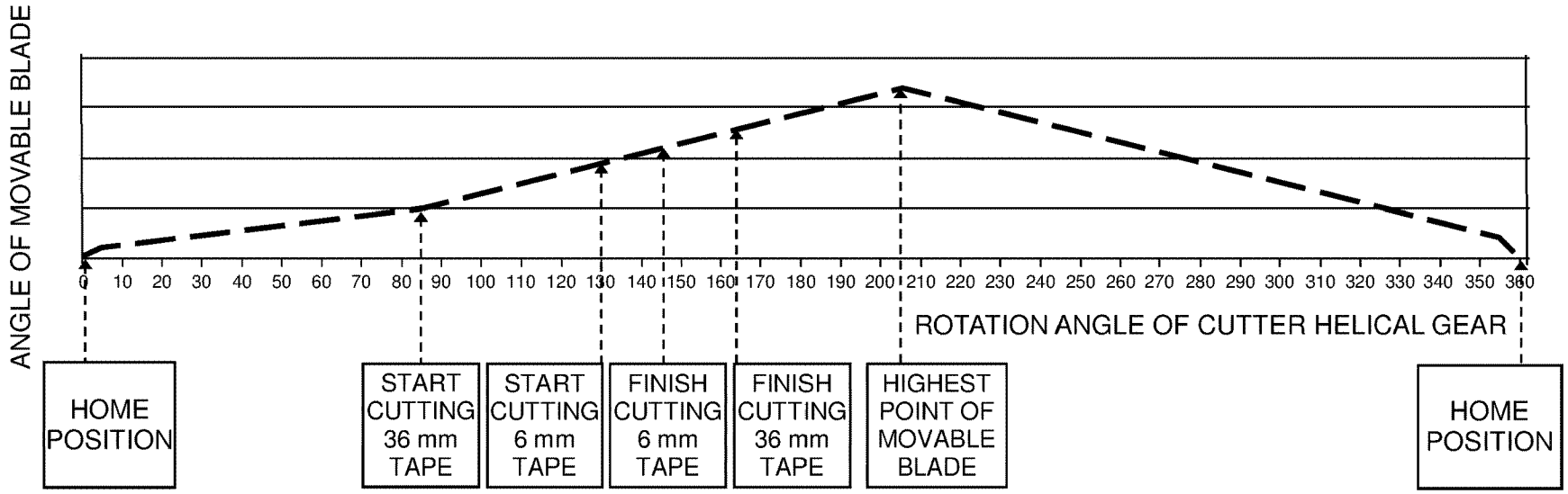

LABEL PRODUCING APPARATUS

CROSS-REFERENCE TO RELATED APPLICATION

The present application claims priority from Japanese Patent Application No. 2017-73627, which was filed on Apr. 3, 2017, the disclosure of which is incorporated herein by reference in its entirety.

BACKGROUND

Field

The present disclosure relates to a label producing apparatus for producing a label which is adhered to an object to be adhered in use.

Description of the Related Art

In a prior art, a label producing apparatus for producing a label is known. A cartridge (tape cassette), around which a label tape (tape) is wound in a roll shape, is mounted on this label producing apparatus (tape-printing apparatus) of the prior art. Desired printing is performed on a tape, which is fed out from the above described roll inside the cartridge, with a thermal head in the label producing apparatus to form a printed label tape. Subsequently, this printed tag label tape is cut into a label tape having a desired length with a cutting mechanism so as to generate a printed label. The generated label is discharged to the outside of the apparatus by a tape discharging mechanism located on a downstream side in a feeding direction of the cutting mechanism.

At this time, the cutting mechanism includes: a movable blade capable of advancing and retreating with respect to a tape feeding path of a tape by a driving force of a cutter motor; and a stationary blade installed on the opposite side of the movable blade across the tape feeding path. The tape discharging mechanism also includes: a driving roller driven by a rotational driving force of a tape discharging motor; and a driven roller (pressing roller) for sandwiching and discharging a label together with this driving roller.

In the above described prior art, two rollers, that is, a motor (cutter motor) for driving the movable blade of the cutting mechanism and a motor (tape discharging motor) for driving the driving roller of the tape discharging mechanism are separately disposed. As the result, an increase in the number of motors has led to an increase in the size and weight of the whole apparatus.

SUMMARY

An object of the present disclosure is to provide a label producing apparatus capable of achieving a reduction in size and a reduction in weight of the whole apparatus by reducing the number of motors.

In order to achieve the above-described object, according to the aspect of the present application, there is provided a label producing apparatus comprising a feeder configured to feed a label tape a movable blade configured to advance and retreat with respect to a tape feeding path and cut the label tape fed by the feeder, a driving roller disposed to a downstream side of the movable blade on the tape feeding path and configured to contact and discharge the label tape, a driven roller configured to advance and retreat with respect to the tape feeding path, a motor configured to rotate in one direction and generate a driving force, a driving force transmission mechanism configured to perform a switching operation between a transmission state where the driving force of the motor is transmitted to the driving roller and an interruption state where the transmission of the driving force to the driving roller is interrupted, and a coordination adjusting mechanism configured to adjust an advancing and retreating operation of the driven roller to the driving roller, an advancing and retreating operation of the movable blade to the tape feeding path, and the switching operation of the driving force transmission mechanism into a desired mutually coordinated-mode, these operations being performed by the driving force of the motor in accordance with a rotation of the motor in the one direction.

In the present disclosure, a label tape is brought out by a feeder from a cartridge mounted on a cartridge holder and is fed on a tape feeding path. A movable blade advances to the label tape, which is fed to an appropriate cutting position, to cut the label tape into a label tape having a desired length. A driven roller advances to sandwich, together with a driving roller, the label tape (label) cut in this manner, and in this state the driving roller rotates to discharge the above described label to the outside of the apparatus.

In the present disclosure, via a coordination adjusting mechanism, in addition to the above described advancing and retreating operation of the above described movable blade with respect to the tape feeding path and the advancing and retreating operation of the above described driven roller with respect to the driving roller, the rotation of the above described driving roller is also performed with a driving force from one common motor. That is, the driving force of the motor is transmitted to the driving roller by a driving force transmission mechanism. This driving force transmission mechanism switches to operate between a transmission state and an interruption state by the coordination adjusting mechanism. In the above described transmission state, the driving roller rotates corresponding to the rotation of the motor in one direction. Accordingly, when the driven roller advances to sandwich a label tape between the driven roller and the driving roller as described above and in this state the above described driving force transmission mechanism becomes in the above described transmission state, then the rotation of the driving roller acts on the label tape to feed the label tape in a discharge direction (in the case that the above described driving force transmission mechanism is in the above described interruption state, the label tape will not be fed).

At this time, in the present disclosure, due to the adjustment by the above described coordination adjusting mechanism, the driving force transmission mechanism will not switch to the above described transmission state at least until the completion of cutting of the label tape by the movable blade, but the above described driving force transmission mechanism switches to the transmission state after the completion of cutting of the label tape by the movable blade. As a result, the rotation of the driving roller before the completion of cutting of the tape and a rotational driving force acting on the label tape can be prevented.

In this manner, in the present disclosure, cutting of the label tape by the movable blade and subsequent discharging of the label can be smoothly and reliably performed utilizing the driving force of one common motor. Accordingly, the number of motors can be reduced as compared with the case that a motor for driving a movable blade and a motor for discharge a label are separately disposed. As the result, a reduction in size and a reduction in weight of the whole apparatus can be achieved, and a reduction in cost can be also achieved.

BRIEF DESCRIPTION OF THE DRAWING

FIG. 1 is a system configuration diagram illustrating a label generating system according to an embodiment of a label producing apparatus of the present disclosure.

FIG. 2 is a perspective view illustrating the whole structure of the label producing apparatus.

FIG. 3 is a plan view illustrating the structure of an internal unit.

FIG. 4 is an enlarged plan view schematically illustrating the detailed structure of a cartridge.

FIG. 5 is a front view of a discharging mechanism and cutting mechanism of the internal unit, seen from the downstream side in a tape feeding direction.

FIG. 6 is a perspective view of the discharging mechanism and cutting mechanism of the internal unit, seen from the downstream side in the tape feeding direction.

FIG. 7 is a perspective view of the discharging mechanism and cutting mechanism excluding a driving motor of the internal unit, seen from the downstream side in the tape feeding direction.

FIG. 8 is a perspective view seen from an arrow B direction in FIG. 7.

FIG. 9 is s rear view of the discharging mechanism and cutting mechanism of the internal unit, seen from the upstream side in the tape feeding direction.

FIG. 10A is a perspective view illustrating the detailed structure of a roller shaft.

FIG. 10B is an exploded perspective view illustrating the detailed structure of the roller shaft.

FIG. 11A is a horizontal sectional view along a XI-XI cross section in FIG. 5.

FIG. 11B is a cross sectional view of an extracted main portion illustrating a state where a locking pawl is separated.

FIG. 12 is a functional block diagram illustrating a control system of the label producing apparatus.

FIG. 13A is a top view illustrating an example of the appearance of a produced label.

FIG. 13B is a bottom view illustrating an example of the appearance of the produced label.

FIG. 13C is a top view illustrating another example of the appearance of a produced label.

FIG. 13D is a bottom view illustrating another example of the appearance of the produced label.

FIG. 14A is a view obtained by rotating counterclockwise, by 90°, a transverse cross section along a XIVA-XIVA' cross section in FIG. 13A.

FIG. 14B is a view obtained by rotating counterclockwise, by 90°, a transverse cross section along a XIVB-XIVB' cross section in FIG. 13A.

FIG. 15 is a flow chart showing a control procedure executed by a control circuit.

FIG. 16 is a flow chart showing the detailed procedure of step S55.

FIG. 17 is a see-through explanatory view in an initial state where a cutter helical gear to be engaged with a movable blade is located at the home position with the rotation angle of 0°, in each operation stage for explaining the coordination between the advancing and retreating operation of the movable blade and the advancing and retreating operation of the pressing roller.

FIG. 18 is a see-through explanatory view for explaining the coordination between the advancing and retreating operation of the movable blade and the advancing and retreating operation of the pressing roller (at the rotation angle of 85°).

FIG. 19 is a see-through explanatory view for explaining the coordination between the advancing and retreating operation of the movable blade and the advancing and retreating operation of the pressing roller (at the rotation angle of 95°).

FIG. 20 is a see-through explanatory view for explaining the coordination between the advancing and retreating operation of the movable blade and the advancing and retreating operation of the pressing roller (at the rotation angle of 102°).

FIG. 21 is a see-through explanatory view for explaining the coordination between the advancing and retreating operation of the movable blade and the advancing and retreating operation of the pressing roller (at the rotation angle of 132°).

FIG. 22 is a see-through explanatory view for explaining the coordination between the advancing and retreating operation of the movable blade and the advancing and retreating operation of the pressing roller (at the rotation angle of 165°).

FIG. 23 is a see-through explanatory view for explaining the coordination between the advancing and retreating operation of the movable blade and the advancing and retreating operation of the pressing roller.

FIG. 24 is a see-through explanatory view for explaining the coordination between the advancing and retreating operation of the movable blade and the advancing and retreating operation of the pressing roller.

FIG. 25 is a see-through explanatory view for explaining the coordination between the advancing and retreating operation of the movable blade and the advancing and retreating operation of the pressing roller (at the rotation angle of 183°).

FIG. 26 is a see-through explanatory view for explaining the coordination between the advancing and retreating operation of the movable blade and the advancing and retreating operation of the pressing roller (at the rotation angle of 205°).

FIG. 27 is a see-through explanatory view for explaining the coordination between the advancing and retreating operation of the movable blade and the advancing and retreating operation of the pressing roller.

FIG. 28 is a see-through explanatory view for explaining the coordination between the advancing and retreating operation of the movable blade and the advancing and retreating operation of the pressing roller (at the rotation angle of 354°).

FIG. 29A is a graph illustrating a relationship between the rotation angle of a cutter helical gear and the pressure onto a printed label tape by a pressing roller.

FIG. 29B is a graph illustrating a relationship between the rotation angle of the cutter helical gear and the angle of the movable blade.

DETAILED DESCRIPTION OF THE PREFERRED EMBODIMENTS

Hereinafter, an embodiment of the present disclosure will be explained with reference to the drawings.

In a label generating system LS illustrated in FIG. 1, a label producing apparatus 1 of this embodiment is connected, in this example, to a terminal 118*a* and general purpose computer 118*b* via a wired or wireless communication line NW. Hereinafter, the terminal 118*a* and general purpose computer 118*b* will be collectively and simply referred to as a "PC 118" as needed. The label producing apparatus 1 in this example produces a label L with a desired print on the basis of an operation from the above described PC 118.

As illustrated in FIG. 2, the label producing apparatus 1 includes an apparatus main body 2 and an opening/closing lid 3 disposed so as to be able to open and close on the upper surface of this apparatus main body 2.

The apparatus main body 2 includes a front wall 10 including a label discharging port 11 for discharging the label L, which is produced inside the apparatus main body 2, to the outside of the apparatus, the label discharging port 11 being located on a near side (on the left front side in FIG. 2).

Moreover, a power button 14 for turning on/off a power supply of the label producing apparatus 1 is disposed on one end part of the front wall 10. A cutter driving button 16 for driving a cutting mechanism 15 (see FIG. 3 described later) arranged inside the apparatus main body 2 by a manual operation of a user is disposed below this power button 14. This button 16 is pushed so as to cut a label tape 109 with print (the detail will be described later) and separate the label L from the apparatus main body.

The opening/closing lid 3 is pivotably supported at an end part on the right deep side in FIG. 2 of the apparatus main body 2, and is constantly urged in an opening direction via an urging member, such as a spring. Then, locking between the opening/closing lid 3 and the apparatus main body 2 is released by pushing the opening/closing button 4, which is arranged so as to adjoin the opening/closing lid 3 in the upper surface of the apparatus main body 2, and the opening/closing lid 3 is opened by the action of the above described urging member.

<Internal Unit>

Next, the structure of an internal unit 20 inside the label producing apparatus 1 will be explained. The internal unit 20 generally includes: as illustrated in FIG. 3, a cartridge holder 6 for storing a cartridge 7; a printing mechanism 21 including a printing head 23; the cutting mechanism 15; a half-cutting mechanism 35 including a half cutter 34; and a label discharging mechanism 22 for discharging the generated label L from the label discharging port 11 (see FIG. 2). Note that, in FIG. 3, for the purpose of avoiding complicated illustration, a driving roller 51 and a pressing roller 52 are conceptually illustrated (for the detailed structure, see FIG. 5 and the like described later).

<Cartridge Holder and Printing Mechanism>

The cartridge holder 6 stores a cartridge 7 so that the orientation in the width direction of the label tape 109 with print discharged from the label discharging port 11 (see FIG. 2) is in the vertical direction.

Next, the detailed structure of the cartridge 7 will be explained. As illustrated in FIG. 4 and FIG. 3, the cartridge 7 includes: a housing 7A; a first roll 102 that is arranged inside this housing 7A and formed by winding a belt-like base tape 101; a second roll 104 that is formed by winding a transparent cover film 103 having the substantially same width as the above described base tape 101; a ribbon supply side roll 111 which feeds out an ink ribbon 105 (a heat transfer printing ribbon, which is not needed in the case that a print-receiving tape is a thermal tape); a ribbon take-up roller 106 for taking up the printed ribbon 105; and a feeding roller 27 rotatably supported in a vicinity of a tape discharging part 30 of the cartridge 7.

The feeding roller 27 compresses and bonds the above described base tape 101 and the above described cover film 103 into the above described label tape 109 with print, and feeds the tape in the direction indicated by an arrow A (the feeding roller 27 functions also as a pressure roller).

The first roll 102 winds the above described base tape 101 around a reel member 102*a*. The base tape 101 has a four-layer structure, in this example, (see a partially enlarged view in FIG. 4), and includes, from a side (right side in FIG. 4) where the tape is wound inward to the opposite side (left side in FIG. 4), an adhesive layer 101*a* including an appropriate adhesive material, a colored base film 101*b* including PET (polyethylene terephthalate) or the like, an adhesive layer 101*c* including an appropriate adhesive material, and a separation sheet 101*d*, which are stacked in this order.

On the front side (right side in FIG. 4) of the base film 101*b*, the above described adhesive layer 101*a* for adhering the cover film 103 later is formed, while on the back side (left side in FIG. 4) of the base film 101*b*, the above described separation sheet 101*d* is adhered to the base film 101*b* via the above described adhesive layer 101*c*.

When the label L finally finished in the shape of a label is adhered to a predetermined product or the like, it can be adhesive thereto via the adhesive layer 101*c* by the separation sheet 101*d* being peeled off.

The second roll 104 winds the above described cover film 103 around a reel member 104*a*. Regarding the cover film 103 fed out from the second roll 104, the ribbon 105, which is arranged on the back side of the cover film 103 (i.e., the side to be adhered to the above described base tape 101) and is driven by the above described ribbon supply side roll 111 and the above described ribbon take-up roller 106, is abutted against the back surface of this cover film 103 by being pressed by the above described printing head 23.

The ribbon take-up roller 106 and the feeding roller 27 are interlocked and rotationally driven by the driving force of a feeding motor 119 (see FIG. 12 described later), which is a pulse motor for example, disposed outside the cartridge 7, the driving force being transmitted to a ribbon take-up roller driving shaft 107 and to a feeding roller driving shaft 108, respectively, via a non-illustrated gear mechanism.

On the other hand, the above described printing head 23 including a large number of heater elements is mounted on a head mounting part 24 disposed upright on the cartridge holder 6, and is arranged on the upstream side in the feeding direction of the cover film 103 from the feeding roller 27.

Moreover, in front (on the lower side in FIG. 3) of the cartridge 7 in the cartridge holder 6, a roller holder 25 is pivotably supported by a support shaft 29, and can be switched between a print position (see FIG. 3) and a release position by a switching mechanism. A platen roller 26 and a pressure roller 28 are rotatably arranged on this roller holder 25. When the roller holder 25 is switched to the above described print position, these platen rollers 26 and pressure roller 28 are pressed onto the above described printing head 23 and the above described feeding roller 27.

In the above described configuration, the base tape 101 fed out from the above described first roll 102 is supplied to the feeding roller 27. On the other hand, as previously described, the ink ribbon 105 is abutted against the back surface of the cover film 103, which is fed out from the second roll 104, by being pressed by the above described printing head 23. When the cartridge 7 is mounted on the above described cartridge holder 6 and the roll holder 25 is moved to the above described print position from the above described release position, the cover film 103 and the ink ribbon 105 are sandwiched between the printing head 23 and the platen roller 26, and the base tape 101 and cover film 103 are sandwiched between the feeding roller 27 and the pressure roller 28. Then, the ribbon take-up roller 106 and the feeding roller 27 are rotationally driven in a synchronous manner in a direction indicated by an arrow B and in a direction indicated by an arrow C, respectively, by the driving force of the above described feeding motor 119. At this time, the above described feeding roller driving shaft 108, the above described pressure roller 28, and platen roller 26 are interlinked via a gear mechanism (not illustrated). The feeding roller 27, the pressure roller 28, and the platen roller 26 rotate along with driving of the feeding roller driving shaft 108. The base tape 101 is fed out from the first roll 102, and is supplied to the feeding roller 27 as described above. On the other hand, the cover film 103 is fed out from the second roll 104, and a plurality of heater elements of the printing head 23 is energized by a print-head driving circuit 120 (see FIG. 12 described later). As the result, a label print R (see FIG. 13 described later) is printed on the back surface of the cover film 103. Then, the above described base tape 101 and the above described printed cover film 103 are adhered and integrated by the above described feeding roller 27 and pressure roller 28, and formed as the label tape 109 with print and carried to the outside of the cartridge 7 from the tape discharging part 30. The ink ribbon 105 having finished printing R onto the cover film 103 is taken up by the ribbon take-up roller 106 by driving the ribbon take-up roller driving shaft 107.

Note that, for example, a tape identification display part 8 (see FIG. 3) for displaying the width, color, and the like of the above described base tape 101 incorporated in the cartridge 7 is disposed on the upper surface of the above described housing 7A of the cartridge 7.

On the other hand, as previously described, the internal unit 20 includes the above described cutting mechanism 15 and the above described label discharging mechanism 22. By the operation of the above described cutter driving button 16 (see FIG. 2) to the label tape 109 with print, which has been generated by being bonded together as described above, the label tape 109 with print is cut with the cutting mechanism 15 (or may be automatically cut at an appropriate timing) to generate the Label L. This label L is discharged later, by the label discharging mechanism 22, from the above described label discharging port 11 formed in the front wall 10 (see FIG. 2).

<Cutting Mechanism>

Next, the cutting mechanism 15 will be explained using FIGS. 5-9 and the above described FIG. 3. Note that, in FIGS. 5-9, for the purpose of avoiding complicated illustration, the cutting mechanism 15 is illustrated in a state where a half-cutting unit described later is excluded.

As the result of bonding as described above, the label tape 109 with print includes, along the layer direction, the cover film 103, the adhesive layer 101*a*, the base film 101*b*, the adhesive layer 101*c*, and the separation sheet 101*d*, which are stacked in this order. The cutting mechanism 15 produces the print label L including the above described print R, by cutting all of these layers. That is, the cutting mechanism 15 includes: a stationary blade 40; a movable blade 41 which performs a cut operation together with this stationary blade 40; a cutter helical gear 42 to be engaged with this movable blade 41; and a driving motor 43 which is operatively interlocked with this cutter helical gear 42 via a gear train 43A including a plurality of gears and which rotates in one direction.

A protrusively formed boss (first pin) 50 is disposed on portions other than the rotation center of the cutter helical gear 42. This boss 50 is inserted into and engaged with a long hole 49 formed in a handle part 46 (basal part) of the movable blade 41 (see FIG. 9). As a result, it is possible to convert the rotational movement based on the rotational drive of the driving motor 43 to a movement in the advance and retreat direction by utilizing the engaged structure of the boss 50 and the long hole 49, and to cause the movable blade 41 to advance and retreat with respect to a tape feeding path TR (see FIG. 3, FIG. 5, and FIG. 9) of the label tape 109 with print.

Further, the cutter helical gear 42 includes a first cam surface 42A, a second cam surface 42B, and a third cam surface 42C whose distance from the rotation center switches in three stages, i.e., a stage in which this distance is short, a stage in which this distance is middle, and a stage in which this distance is long, respectively, the first cam surface 42A, second cam surface 42B, and third cam surface 42C being protrusively disposed in a flange shape in a predetermined circumferential range of a cylindrical outer wall of the cutter helical gear 42. A cylindrical part 306A of an actuating member 60 described later can slide on these cam surfaces.

The stationary blade 40 is fixed to a side plate 44 (see FIG. 3) disposed standing on a side part of the cartridge holder 6, with a screw or the like through a fixing hole.

As illustrated in FIG. 9 and the like, the movable blade 41 is substantially V-shaped, and includes: a blade part 45 disposed on the cutting part; the above described handle part 46 located on the opposite side of the blade part 45; and a bend part 47. A shaft hole 48 is disposed on the stationary blade. The movable blade 41 is supported by the above described side plate 44 so that it can pivot, with the bend part 47 as a supporting point, via a rotary shaft (not illustrated) disposed on the shaft hole 48. Moreover, the above described long hole 49 is formed in the above described handle part 46 on the opposite side of the blade part 45 of the movable blade 41. The blade part 45 is formed, for example, from a two-stage blade, and the blade surface thereof includes two tilted surfaces, i.e., a first tilted surface and a second tilted surface, each having a different tilt angle and causing the thickness of the blade part 45 to gradually thin.

In the cutting mechanism 15 having the above described configuration, when the cutter helical gear 42 is rotated by the driving motor 43, the movable blade 41 swings, with the rotary shaft of the above described shaft hole 48 as a supporting point, by the boss 50 and long hole 49, and advances toward the tape feeding path TR of the label tape 109 with print to cut the label tape 109 with print.

That is, first, in the case that the boss 50 of the cutter helical gear 42 is located on an inner side (right side in FIG. 9), the movable blade 41 (precisely speaking, the blade part 45, the same applies hereafter) is located away from the stationary blade 40 (initial state). Then, in this initial state, as the driving motor 43 drives the cutter helical gear 42 to rotate clockwise (direction of an arrow 70) in FIG. 9, the boss 50 moves outward and the movable blade 41 pivots clockwise (direction of an arrow 73) in FIG. 9 about the above described rotary shaft to cut the label tape 109 with print in cooperation with the stationary blade 40 (for the details, see also FIGS. 17-28 described later).

<Label Discharging Mechanism>

On the other hand, the above described label discharging mechanism 22 is disposed in a vicinity of the label discharging port 11 disposed on the front wall 10 (see FIG. 2) of the apparatus main body 2, and forcibly discharges, from the label discharging port 11, the label tape 109 with print (in other words, the above described label L, the same applies hereafter) which has been already cut by the cutting mechanism 15. That is, the label discharging mechanism 22 includes: the driving roller 51 for touching and discharging the label tape 109 with print, the driving roller 51 being disposed to the downstream side of the tape feeding path TR from the movable blade 41; and the pressing roller 52 facing this driving roller 51 across the tape feeding path TR of the label tape 109 with print.

The driving roller 51 is rotationally driven by the driving force of the above described driving motor 43 being transmitted via the above described gear train 43A (gear mechanism) to a roller shaft RS having a three-block structure with a spring described later.

<Half-Cutting Unit>

Next, the detailed configuration of the half-cutting unit will be explained. As previously described, the label tape 109 with print includes, along the layer direction, the cover film 103, the adhesive layer 101*a*, the base film 101*b*, the adhesive layer 101*c*, and the separation sheet 101*d*, which are stacked in this order. Among these layers, the half-cutting unit cuts the layers (cover film 103, adhesive layer 101*a*, base film 101*b*, and adhesive layer 101*c*) other than the separation sheet 101*d*. That is, as illustrated in FIG. 3, the half-cutting unit includes: in this example, a receiving stage 38 arranged in alignment with the stationary blade 40; the half cutter 34 configured to cut the layers other than the above described separation sheet 101*d*, the half cutter 34 facing this receiving stage 38 and being arranged on the movable blade 41 side; a first guide part 36 arranged together with the stationary blade 40 between the stationary blade 40 and receiving stage 38; and a second guide part 37 facing this first guide part 36 and being arranged together with the movable blade 41.

<Coordination Between Advance and Retreat of Movable Blade and Advance and Retreat of Pressing Roller, and Switching of Driving Force Transmission>

Here, in this embodiment, the rotational drive of the driving roller 51 and the advancing and retreating operation of the movable blade 41 are performed with the driving force from one common driving motor. In this embodiment, as the driving motor 43 rotates in one direction, the advancing and retreating operation of the above described movable blade 41 to the tape feeding path TR and the advancing and retreating operation of the pressing roller 52 to the driving roller 51 are adjusted into a desired mutually coordinated-mode. Moreover, in this case, the above described driving force transmission mechanism is switched between a transmission state where the above described roller shaft RS transmits the driving force of the driving motor 43 to the driving roller 51 and an interruption state where the above described roller shaft RS does not perform the transmission of this driving force but interrupt. Hereinafter, the details thereof will be explained step by step.

<Coordination Between Advance and Retreat of Movable Blade and Advance and Retreat of Pressing Roller>

First, in coordinating the above described advancing and retreating operation of the movable blade 41 and the above described advancing and retreating operation of the pressing roller 52, as illustrated in FIGS. 5-8 the so-called crank/swing-lever mechanism, for example, is used for converting a rotational movement to an advance and retreat (translation-reciprocating) movement. That is, in order to support the pressing roller 52, which is pressed by the driving roller 51, so as to be able to advance and retreat, the substantially T-shaped actuating member 60 is arranged so as to be able to rotate (swing) via a rotary shaft 163 disposed to an end part thereof. Moreover, the first cam surface 42A, the second cam surface 42B, and the third cam surface 42C whose distance (length in a radial direction) from the rotation center switches in three stages, i.e., a stage in which this distance is short, a stage in which this distance is middle, and a stage in which this distance is long, respectively, are formed in the circumferential face of the cutter helical gear 42. Then, as the cutter helical gear 42 rotates, the cylindrical part 306A corresponding to one of the both ends of a T-shaped horizontal part of the actuating member 60 sequentially slides on the first cam surface 42A, the second cam surface 42B, and the third cam surface 42C.

On the other hand, as illustrated in FIGS. 5-8, a roller supporting mechanism 307 for supporting the above described pressing roller 52 is connected to an apex 306B corresponding to the other one of the above described both ends of the horizontal part of the T-shaped horizontal part of the actuating member 60. This roller supporting mechanism 307 includes a piston part 307A and a cylinder part 307B.

The piston part 307A pivotably supports a rotary shaft 52A of the pressing roller 52 at a part on the tip end side thereof (left side in FIG. 5), and supports the pressing roller 52 so as to be able to rotate, and a part on the back-end side thereof (right side in FIG. 5) is hinge-coupled with the above described apex 306B via a coupling member 36. Moreover, a non-illustrated spring member is incorporated into the piston part 307A, so that by causing an urging force of this spring member to act on the above described rotary shaft 52A, the label tape 109 with print can be pressed with an appropriate pressure (see FIG. 29 described later). The cylinder part 307B is fixed to a guide wall 55 (see FIG. 6) for guiding the label tape 109 with print to the label discharging port 11, and stores the piston part 307A and at the same time supports this piston part 307A so as to be able to slide in the horizontal direction (see an arrow in FIG. 5). As a result, the roller supporting mechanism 307 supports the pressing roller 52 so as to be able to rotate and able to advance and retreat with respect to the driving roller 51.

Then, the cylindrical part 306A of the above described actuating member 60 slides from the above described first cam surface 42A to the above described third cam surface 42C through the second cam surface 42B and is pushed upwards in FIG. 5. Thus, the actuating member 60 rotates counterclockwise around the rotary shaft 163 and the above described apex 306B is displaced to the left hand in FIG. 5, and the above described pressing roller 52 advances, via the coupling member 36 and the piston part 307A, to the tape feeding path TR side of the above described label tape 109 with print (see FIGS. 17-26 and the like described later). Subsequently, the cylindrical part 306A of the above described actuating member 60 slides from the above described third cam surface 42C to the above described first cam surface 42A and returns downward in FIG. 5. As the result, the actuating member 60 rotates clockwise around the rotary shaft 163, and the above described apex 306B is displaced to the right hand in FIG. 5, and the above described pressing roller 52 retreats, via the coupling member 36 and piston part 307A, in a direction away from the above described tape feeding path TR (see FIGS. 27-28 and the like described later).

In this manner, in this embodiment, the movable blade 41 is caused to advance and retreat by rotating the driving motor 43 in one direction. Interlocked with the advancing and retreating operation of the movable blade 41, the pressing roller 52 supported by the roller supporting mechanism 307 is caused to advance and retreat with respect to the driving roller 51. Specifically, the pressing roller 52 can advance and retreat between a position, where the pressing roller 52 can touch, from the opposite side of the driving roller 51, the label tape 109 with print located on the tape feeding path TR and sandwich the label tape 109 with print together with this driving roller 51, and a position slightly spaced from the label tape 109 with print located on the tape feeding path TR (for the detailed operation mode, see FIGS. 17-28 described later).

Note that, as illustrated in FIGS. 5-7, the actuating member 60 is urged by the spring member 62 so as to retreat backward from the tape feeding path TR, i.e., so that the pressing roller 52 is away from the driving roller 51. At this time, in the spring member 62, one end side thereof (right side in each view) winds around the rotary shaft 163, while another end side thereof (left side in each view) is fixed to a lower part of the above described guide wall 55.

<Switching of Transmission of Driving Force of Roller Shaft>

Next, switching between the above described transmission state where the driving force of the driving motor 43 is transmitted to the driving roller 51, and the above described interruption state where the transmission of the driving force is not performed but is interrupted, in the above described roller shaft RS will be explained.

As illustrated in FIG. 10A and FIG. 10B, the above described roller shaft RS includes: a driving part 300 to which the driving force of the driving motor 43 is input via the above described gear train 43A; a driven part 302 to which the above described pressing roller 52 is fixed; and a coil spring 301 for transmitting a driving force via a frictional force between the driving part 300 and the driven part 302. While the driven part 302 is locked, the coil spring 301 rotates together with the driving part 300 and slides on the driven part 302. In this example, the driving part 300 is configured to rotate in a direction along which the coil spring 301 is relaxed.

In the roller shaft RS of this configuration, as illustrated in FIG. 10A and FIG. 10B, in a state where the above described coil spring 301 is wound on the outer peripheral side of an upper end part 300U of the driving part 300, a lower end part 302L of the driven part 302 is engaged with this upper end part 300U. As a result, in the normal time, the urging force of the coil spring 301 acts on the above described upper end part 300U and on the above described lower end part 302L, so that the state becomes a transmission state where the driving force associated with the rotation of the above described driving motor 43 in one direction is transmitted to the driving roller 51 via the driving part 300, the coil spring 301, and the driven part 302 to cause the driving roller 51 to rotate in a direction along which a label tape is discharged.

At this time, an outer groove 302*a* is disposed on an outer peripheral part of the driven part 302. Then, a flexible locking piece 304 is disposed on a shaft support frame SF for supporting the above described roller shaft RS so as to be able to rotate. A wedge-shaped protrusive locking pawl 304*a* is disposed on a tip end of this locking piece 304, and this locking pawl 304*a* is normally engaged with (latched into) the outer groove 302*a* of the above described driven part 302 of the above described roller shaft RS (see FIG. 11A). While the locking pawl 304*a* is engaged with the outer groove 302*a* in this manner, the rotation in the circumferential direction of the driven part 302 is prevented. That is, although the driving force associated with the rotation in one direction of the driving motor 43 is transmitted to the coil spring 301 via the driving part 300 as described above, the rotation of the driven part 302 is prevented as described above. Therefore, the coil spring 301 and the lower end part 302L of the above described driven part 302 slip each other, resulting in the interruption state where the transmission of the driving force to the driving roller 51 is interrupted.

At this time, as illustrated in FIGS. 5-7, the actuating member 60 further includes a substantially tapered arm part 305 corresponding to a leg of the above described T-shaped part. Then, the tip end of this arm part 305 can abut against the above described locking piece 304 (specifically, a tilted part 304*b*: see FIG. 7 and the like). In the above described interruption state, when the actuating member 60 rotates clockwise around the rotary shaft 163 and the arm part 305 abuts against the tilted part 304*b* of the above described locking piece 304 as described above, the above described locking piece 304 bends and the locking pawl 304*a* separates from the outer groove 302*a* (see FIG. 11B). As the result, interruption of the rotation in the circumferential direction of the above described driven part 302 is released and the driven part 302 is allowed to rotate, so that the state becomes the above described transmission state where the driving roller 51 is allowed to rotate.

Note that the above described locking piece 304 functions to lock the above described driven part 302 by a rotation behavior of the actuating member 60 as described later so as not to be able to rotate at least until the completion of cutting of the label tape by the movable blade 41, and functions to release the locking to the above described driven part 302 after the completion of cutting of the label tape by the movable blade 41, and allow the rotation of this driven part 302 (the details will be described later).

As described above, in this embodiment, as the driving motor 43 rotates in one direction, the advancing and retreating operation with respect to the driving roller 51 of the pressing roller 52, the advancing and retreating operation with respect to the tape feeding path TR of the movable blade 41, and the switching operation between the above described transmission state and interruption state in the above described roller shaft RS are adjusted into a desired mutually coordinated-mode. The details of this adjustment procedure will be described later (see FIGS. 17-28).

<Control System>

Next, a control system of the label producing apparatus 1 will be explained using FIG. 12. In FIG. 12, a control circuit 110 is arranged on a control board (not illustrated) of this label producing apparatus 1.

The control circuit 110 includes: a CPU 111 which includes a timer 111A and controls each device; an input/output interface 113 connected to this CPU 111 via a data bus 112; a CGROM 114; a ROM 115 and a ROM 116; and a RAM 117.

In the CGROM 114, for example dot pattern data related to each of a large number of characters is stored corresponding to coded data.

In the ROM (dot pattern data memory) 115, with regard to each of a large number of characters for printing the characters, such as an alphabetic letter and a mark, printing dot pattern data is grouped for each font (Gothic font, Mincho font, etc.) and a printing character size of data corresponding to the coded data is stored for each font. Moreover, graphic pattern data for printing a graphic image including gradation expression is also stored.

Note that, the dot pattern data for displaying and printing stored in the CGROM 114 and ROM 115 can be read from the PC 118 side via the above described communication line NW, and may be displayed and/or printed on the PC 118 side which has received this data.

In the ROM 116, a print drive control program for reading the data of a print buffer corresponding to the coded data of characters, such as the letter and number, input from the above described PC 118 and for driving the above described printing head 23 and feeding motor 119; a number-of-pulses determining program for determining the number of pulses corresponding to the formation energy amount of each print dot; a cutting drive control program for driving, upon completion of printing, the feeding motor 119 to feed the label tape 109 with print to a cutting position, and then driving the above described driving motor 43 to cut the label tape 109 with print; a tape discharging program for driving the driving motor 43 to forcibly discharge the cut label tape 109 with print (label L) from the label discharging port 11; and other various types of programs required for controlling the label producing apparatus 1 are stored. The CPU 111 performs various types of calculations on the basis of various types of programs stored in such ROM 116.

The RAM 117 includes a text memory 117A, a print buffer 117B, a parameter storing area 117E, and the like. Document data input from the PC 118 is stored in the text memory 117A. Printing dot pattern, such as a plurality of letters and marks, is stored as dot pattern data in the print buffer 117B, and the printing head 23 performs dot printing in accordance with the dot pattern data stored in this print buffer 117B. Various types of calculation data are stored in the parameter storing area 117E.

The PC 118, the above described print-head driving circuit 120 for driving the printing head 23, a feeding-motor driving circuit 121 for driving the feeding motor 119, a drive circuit 122 for driving the driving motor 43, a half-cutter motor driving circuit 128 for driving a half-cutter motor 129, a tape cut sensor 124, and a cut-release detecting sensor 125 are connected to the input/output interface 113, respectively. Note that, in the case that the half cutter 34 is not disposed, the half-cutter motor 129 and the half-cutter motor driving circuit 128 are omitted.

In a control system with such a control circuit 110 as a core, in the case that character data or the like is input via the PC 118, a text (document data) thereof is sequentially stored into the text memory 117A, the printing head 23 is driven via the drive circuit 120, each heater element is selectively heated and driven corresponding to one line of print dots, the dot pattern data stored in the print buffer 117B is printed, and in synchronization with this the feeding motor 119 feeds and controls a tape via the drive circuit 121.

At this time, the above described tape cut sensor 124 and the above described cut-release detecting sensor 125 each includes, as illustrated in the above described FIG. 6, FIG. 9 and the like, the above described first cam surface 42A and a microswitch 126.

Specifically, in a normal standby state (at a home position), the microswitch 126 becomes in an on-state by being pushed by the action of the first cam surface 42A. From this state, in cutting the above described label tape 109 with print, the cutter helical gear 42 rotates in one direction (direction of the arrow 70 in FIG. 9) by the driving motor 43 and the movable blade 41 advances. Subsequently, at the timing when the cutting of the label tape 109 with print is complete due to the advancement of the movable blade 41, the first cam surface 42A disappears at a relevant circumferential position and thus the microswitch 126 will not be pushed anymore and the state returns to the off-state from the on-state (see step S65 in FIG. 16 described later). As the result, the completion of cutting of the label tape 109 with print by the movable blade 41 is detected. The tape cut detecting sensor 124 is configured in this manner.

Moreover, as the cutter helical gear 42 further rotates in one direction (direction of the arrow 70 in FIG. 9), the first cam surface 42A appears again at a certain circumferential position and the microswitch 126 is pushed to switch from the off-state to the on-state (see step S70 in FIG. 16 described later). As the result, a fact is detected that the movable blade 41 has returned to the above described home position. The cut-release detecting sensor 125 is configured in this manner.

<Configuration of Label>

The label L formed by the completion of cutting of the label tape 109 with print by the label producing apparatus 1 of the configuration as described above has, as illustrated in FIG. 13A, FIG. 13B, FIG. 14A, and FIG. 14B, a five-layer structure with the cover film 103 added to the above described four-layer structure illustrated in FIG. 4. That is, the label L includes the cover film 103, the adhesive layer 101*a*, the base film 101*b*, the adhesive layer 101*c*, and the separation sheet 101*d*, which are stacked toward the opposite side (lower side in FIG. 14) from the cover film 103 side (upper side in FIG. 14). Then, the label print R (letters of "ABCD" in this example) is printed on the back surface of the cover film 103.

Moreover, half-cutting lines HC (a front half-cutting line HC1 and a back half-cutting line HC2, in this example) are formed substantially along the tape width direction by the above described half cutter 34 in the cover film 103, adhesive layer 101*a*, base film 101*b*, and adhesive layer 101*c*, as already described. In the cover film 103, an area sandwiched by these half-cutting lines HC1 and HC2 serves as a print area S where the label print R is to be printed, while the both sides in the longitudinal direction of the tape across the half-cutting lines HC1 and HC2 from the print area S serve as a front blank-area S1 and a back blank-area S2, respectively.

Note that, in the case that the half-cutting unit 35 is omitted as described above, the appearance becomes the one without the above described half-cutting lines HC1 and HC2 as illustrated in FIG. 13C and FIG. 13D each corresponding to FIG. 13A and FIG. 13B.

<Control Procedure>

Next, a control procedure executed by the above described control circuit 110 will be explained using FIG. 15.

In FIG. 15, this flow will be started, for example once a label producing operation is performed by the above described PC 118. First, in step S1, an operation signal from the above described PC 118 is input (via the communication line NW and input/output interface 113), and on the basis of this operation signal, the preparation processing of performing the generation of printing data, the setting of front and back half-cutting positions and/or full-cutting position, and the like is executed. Note that, at this time, the above described printing data includes a print length L1 described later.

In step S5, a control signal is output to the feeding-motor driving circuit 121 via the input/output interface 113, and the feeding roller 27 and ribbon take-up roller 106 are rotationally driven by the driving force of the feeding motor 121. Thus, the base tape 101 is fed out from the first roll 102 and supplied to the feeding roller 27 and the cover film 103 is fed out from the second roll 104. Then, these base tape 101 and cover film 103 are adhered and integrated by the above described feeding roller 27 and the pressure roller 28, and formed as the label tape 109 with print, and is further fed to the outside of the label producing apparatus 1 from the outside of the cartridge 7.

Subsequently, in step S10, it is determined whether or not a feed amount D due to the tape feeding started from the above described step S5 becomes a predetermined Do. This Do is for determining whether or not a tip end part in the feeding direction of the above described print area S based on the above described printing data has arrived at a position directly facing the printing head 23 (in other words, whether or not the cover film 103 has arrived at a print start position of the printing head 23). The value of Do is determined together with the setting of the above described print area S in the preparation processing of the above described step S1. The determination of step S10 is not satisfied until D=Do is established, i.e., until the cover film 103 arrives at the print start position, resulting in a standby state by loop. If the cover film 103 has arrived at the print start position, then the determination of step S10 is satisfied and the flow transitions to step S15.

In step S15, a control signal is output to the print-head driving circuit 120 via the input/output interface 113 to energize the printing head 23, and start printing the label print R, such as the letter, mark, and bar code corresponding to the printing data generated in step S1, having the print length L1 to the above described print area S in the cover films 103.

Subsequently, in step S20, it is determined whether or not the label tape 109 with print has been fed to the front half-cutting position set in the previous step S1 (in other words, whether or not the label tape 109 with print has arrived at a position, where the half cutter 34 of the half-cutting mechanism 35 directly faces the front half-cutting line HC1 set in step S1). For the determination at this time, for example it is sufficient to count the number of pulses after the timing of the above described step S10, output by the feeding-motor driving circuit 121 for driving the above described feeding motor 119 which is a pulse motor, and determine whether or not this count number has reached a predetermined value. The determination is not satisfied until arriving at the front half-cutting position, then this procedure is repeated and when arrived, then the determination is satisfied and the flow transitions to step S25.

In step S25, a control signal is output to the feeding-motor driving circuit 121 via the input/output interface 113 to stop driving the feeding motor 119 and stop the rotation of the feeding roller 27 and ribbon take-up roller 106. As a result, in the course of the movement of the label tape 109 with print, which is fed out from the cartridge 7, to the discharge direction and in a state where the half cutter 34 of the half-cutting mechanism 35 directly faces the front half-cutting ine HC1 set in step S1, the feeding-out of the base tape 101 from the first roll 102, the feeding-out of the cover film 103 from the second roll 104, and the feeding of the label tape 109 with print are stopped. Moreover, at this time, a control signal is output also to the print-head driving circuit 120 via the input/output interface 113 to stop energizing the printing head 23 and stop printing (interrupt to print) the above described label print R.

Subsequently, in step S30, front half-cutting processing is performed, in which a control signal is output to the half-cutter motor driving circuit 128 via the input/output interface 113 to drive the half-cutter motor 129 and cause the half cutter 34 to pivot and cut the cover film 103, adhesive layer 101*a*, base film 101*b*, and adhesive layer 101*c* of the label tape 109 with print to form the front half-cutting line HC1.

Then, transitioning to step S35, as with the above described step S5, the feeding roller 27 and the ribbon take-up roller 106 are rotationally driven to resume feeding the label tape 109 with print and as with step S15 the printing head 23 is energized to resume printing the label print R. Note that, as described above, in the case that the half cutter 34 is not disposed, the above described step S20, step S25, step S30, and step S35 are omitted.

In step S250, it is determined whether or not the feed amount D becomes equal to or greater than the print length L1, i.e., whether or not the above described back-end part in the feeding direction of the print area S has arrived at a position directly facing the printing head 23 (in other words, whether or not the cover film 103 has arrived at a print finishing position of the printing head 23). The determination at this time may be also performed by counting the number of pulses for driving the feeding motor 119, as with step S20. The determination is not satisfied until D≥L1 is established, i.e., until the cover film 103 has arrived at the print finishing position, then this procedure is repeated and when the cover film 103 has arrived at the print finishing position, then the determination is satisfied and the flow transitions to step S260.

In step S260, as with the above described step S25, the energization of the printing head 23 is stopped to stop printing the above described label print R. Thus, the printing of the label print R to the print area S of the cover film 103 is complete.

Subsequently, transitioning to step S270, back half-cutting processing is performed, in which after feeding the tape to a back half-cutting position, which is stationarily set to a predetermined position from the rear end of the print area S (set in step S1), the back half-cutting line HC2 is formed with the half cutter 34 of the half-cutting unit 35.

Then, transitioning to step S45, it is determined whether or not the label tape 109 has arrived at a position where a cutout line CL (set in step S1) of the label tape 109 with print directly faces the movable blade 41 of the cutting mechanism 15 (in other words, whether or not the label tape 109 with print has been fed to a full cutting position). The determination at this time may be also performed by counting the number of pulses for driving the feeding motor 119, as with step S20. The determination is not satisfied until arriving at the full-cutting position, then this procedure is repeated and when arrived, then the determination is satisfied and the flow transitions to step S50.

In step S50, as with the above described step S25, the rotation of the feeding roller 27 and ribbon take-up roller 106 is stopped to stop feeding the label tape 109 with print. As a result, in a state where the movable blade 41 of the cutting mechanism 15 directly faces the cutout line CL set in step S1, the feeding-out of base tape 101 from the first roll 102, the feeding-out of the cover film 103 from the second roll 104, and the feeding of the label tape 109 with print are stopped.

Subsequently, in step S55, cut and discharge processing (for the details, see FIG. 16) is performed, in which a control signal is output to the motor driving circuit 122 to drive the driving motor 43 and cause the movable blade 41 of the cutting mechanism 15 to pivot, thereby cutting (dividing) all of the cover film 103, the adhesive layer 101*a*, the base film 101*b*, the adhesive layer 101*c*, and the separation sheet 101*d* of the label tape 109 with print and forming the cutout line CL (see FIGS. 13A-13D) and discharging the cut label L. In this cut and discharge processing, the label tape 109 with print is separated by being divided by the cutting mechanism 15 and this divided label tape 109 is sandwiched and discharged by the driving roller 51 and pressing roller 52, thereby generating the label L on which desired printing has been performed. Subsequently, this flow is terminated.

<Cut and Discharge Processing>

The detailed procedure of the cut and discharge processing of the above described step S55 will be explained using FIG. 16. Note that, as previously described, at a time when this flow starts, the movable blade 41 has already returned to the home position, and the microswitch 126 of the cut-release detecting sensor 125 is already pushed with the first cam surface 42A of the cutter helical gear 42 and is already in the on-state.

First, in step S60, a control signal is output to the drive circuit 122 to start driving the driving motor 43 in the above described one direction. As a result, the cutter helical gear 42 rotates in the corresponding direction to start the cutting of the label tape 109 with print by the movable blade 41 and the discharging of the label L coordinated with this cutting by the driving roller 51 and the pressing roller 52 (the detailed mode of the coordination will be described later).

Subsequently, transitioning to step S65, it is determined whether or not the microswitch 126 has switched from the on-state to the off-state as the result of disappearing of the first cam surface 42A of the above described cutter helical gear 42 due to the rotation of the above described cutter helical gear 42. If it has switched from the on-state to the off-state, then the determination is satisfied and as previously described the cutting of the label tape 109 with print by the movable blade 41 is regarded as having been completed and the flow transitions to step S70.

In step S70, it is determined whether or not the microswitch 126 has switched from the off-state to the on-state due to the further rotation of the cutter helical gear 42 and the appearance of the first cam surface 42A of the above described cutter helical gear 42. If the microswitch 126 has switched from the off-state to the on-state, then the determination is satisfied and the movable blade 41 is regarded as having returned to the home position and the flow transitions to step S75.

In step S75, a control signal is output to the drive circuit 122 to stop driving the driving motor 43. As a result, the rotation of the cutter helical gear 42 stops and the movable blade 41 is in a standby state, at the home position, for the next operation.

<Coordinated Operation Between Advance and Retreat of Movable Blade and Advance and Retreat of Pressing Roller>

Next, the details of the coordination between the advancing and retreating operation with respect to the tape feeding path TR of the above described movable blade 41 and the advancing and retreating operation with respect to the driving roller 51 of the pressing roller 52 will be explained.

Hereinafter, the above described coordination mode will be explained step by step on the basis of FIG. 17 to FIG. 29. FIG. 17 to FIG. 28 are see-through explanatory views illustrating the situations of the above described advancing and retreating operation. FIG. 29 is a graph illustrating a relation between the rotation angle of the above described cutter helical gear 42, the pressure to the label tape 109 with print of the above described pressing roller 52, and the angle of the movable blade 41. Note that, in FIG. 29A, for the purpose of comparison, the behavior in the configuration of JP, A, 2012-139778 is also illustrated as a comparative example, in which the roller shaft RS does not have the above described interruption function, and the rotational driving force of a driving motor is constantly transmitted to a pressing roller via a gear train, and the roller shaft RS rotates.

First, in this example, as illustrated in FIG. 17, the boss 50 is located at substantially the same horizontal height position seen from the center of the cutter helical gear 42, and the cylindrical part 306A of the actuating member 60 slides on the first cam surface 42A of the cutter helical gear 42. In this state, the movable blade 41 is in a standby state at the home position which is away from the label tape 109 with print located on the tape feeding path TR (the home position which is the rotation angle "0°" of the above described cutter helical gear 42: also see FIG. 29A and FIG. 29B). At this time, the above described arm part 305 of the actuating member 60 is largely away from the above described locking piece 304 and the locking pawl 304*a* maintains the locking state with the above described outer groove 302*a*, and as the result, the roller shaft RS is in the above described interruption state. Moreover, the above described apex 306B of the actuating member 60 is largely retreated from the above described tape feeding path TR by the actuating member 60 being pressed by the urging force of the above described spring member 62, and the pressing roller 52 is away, by a predetermined distance, from the label tape 109 with print located on this tape feeding path TR. Note that, as described earlier, at this point the microswitch 126 of the cut-release detecting sensor 125 is already in the ON state.

Subsequently, the driving motor 43 starts rotating. This rotational driving force is transmitted to the cutter helical gear 42 via the gear train 43A as previously described, and by the rotation of this cutter helical gear 42 the movable blade 41 starts advancing toward the label tape 109 with print. At this time, the cylindrical part 306A of the actuating member 60 still slides on the first cam surface 42A of the cutter helical gear 42. Moreover, although the above described rotational driving force is transmitted to the above described driving part 300 of the roller shaft RS via the above described gear train 43A, the above described arm part 305 of the actuating member 60 is continuously away from the above described locking piece 304 (although it slightly descends) and the roller shaft RS is in the above described interruption state (a state where the rotation of the driven part 203 is interrupted by the locking pawl 304*a*). Therefore, the driven part 203 will not rotate and as the result the driving roller 51 will not rotate, either. Moreover, at this time point, although the above described apex 306B of the actuating member 60 advances slightly to the above described tape feeding path TR side, the pressing roller 52 continues to maintain the above described separated state.

Subsequently, when the cutter helical gear 42 further rotates due to the rotation of the driving motor 43, the actuating member 60 rotates counterclockwise, in the view, about the rotary shaft 163. As illustrated in FIG. 18, when the cutter helical gear 42 rotates by 85°, for example, from the above described home position, the cylindrical part 306A continues to slide on the above described first cam surface 42A, but the movable blade 41 advances toward the above described tape feeding path TR to start cutting the label tape 109 with print (see FIG. 29B. However, this is the case of a tape of 36 [mm] which is the widest width assumed to be used in this label producing apparatus 1. In the case of a tape of 6 [mm] which is the narrowest width, cutting is started at a further later timing. Hereinafter, the above described tape having the widest width will be explained as an example, unless otherwise stated). Although the above described arm part 305 of the actuating member 60 further slightly descends, it continues to be away from the above described locking piece 304, and the above described interruption state of the roller shaft RS is maintained. Moreover, although the above described apex 306B of the actuating member 60 further slightly advances to the above described tape feeding path TR side, the pressing roller 52 continues to maintain the above described separated state.

Subsequently, when the cutter helical gear 42 further rotates due to the rotation of the driving motor 43, and as illustrated in FIG. 19 rotates by 95°, for example, from the above described home position, the cylindrical part 306A of the actuating member 60 is switching from the sliding on the above described first cam surface 42A to the sliding on the second cam surface 42B, and the movable blade 41 continues to cut the label tape 109 with print in the width direction (vertical direction in the view). Moreover, although the above described arm part 305 of the actuating member 60 further slightly descends, it continues to be away from the above described locking piece 304, and the above described interruption state of the roller shaft RS is maintained.

At this time, the above described apex 306B of the actuating member 60 further advances slightly to the above described tape feeding path TR side, and the pressing roller 52 contacts the label tape 109 with print located on the tape feeding path TR, and starts holding this label tape 109 with print. As the cutter helical gear 42 further rotates due to the subsequent rotation of the driving motor 43, the pressing roller 52 linearly increases the holding pressure (see FIG. 29A). Note that, while this holding pressure is increasing, the spring member inside the above described piston part 307A maintains the overall length thereof without relaxing.

Subsequently, when the cutter helical gear 42 further rotates due to the rotation of the driving motor 43 and as illustrated in FIG. 20 the cutter helical gear 42 rotates by 102°, for example, from the above described home position, the cylindrical part 306A of the actuating member 60 runs over the second cam surface 42B of the cutter helical gear 42, resulting in a sliding state.

Further later, when the cutter helical gear 42 further rotates by 120°, for example, from the above described home position due to the rotation of the driving motor 43, the above described spring member inside the above described piston part 307A starts relaxing and accordingly a linear increase in the above described holding pressure stops (see FIG. 29A). Hereinafter, the above described holding pressure is held at a predetermined constant pressure due to the relaxing of the above described spring member.

Then, when the cutter helical gear 42 further rotates due to the rotation of the driving motor 43 and as illustrated in FIG. 21 rotates by 132°, for example, from the above described home position, the movable blade 41 further advances toward the above described tape feeding path TR. Note that, in the case of the label tape 109 with print of 6 [mm] which is the narrowest width assumed to be used in this label producing apparatus 1, cutting is started at this timing (see FIG. 29B).

Subsequently, when the cutter helical gear 42 further rotates due to the rotation of the driving motor 43 and the movable blade 41 continues to cut, and the cutter helical gear 42 rotates by 165°, for example, from the above described home position, then as illustrated in FIG. 22, cutting (full cutting) of the dimension in the full-width direction of the label tape 109 with print with the movable blade 41 is complete (however, this is the case of a tape of 36 [mm] which is the widest width assumed to be used in this label producing apparatus 1. In the case of a tape of 6 [mm] which is the narrowest width, when the cutter helical gear 42 rotates, for example, by 145°, for example, which is smaller than 160°, from the above described home position, cutting is complete. See FIG. 29B). Note that, from immediately after this state to a state illustrated in FIG. 26 described later, similarly in this state (or immediately after this state), the second cam surface 42B, which has been pushing up the above described microswitch 126, disappears, and thus the microswitch 126 becomes in the OFF state, and the completion of cutting of the label tape 109 with print is detected by the above described control circuit (see step S65 in the above described FIG. 16). Note that, in FIG. 24 and FIG. 25, for the purpose of clarifying the movement of the actuating member 60, the posture and tilt of each component are exaggerated and the cylindrical part 306A is away from the above described second cam surface 42B, but actually the cylindrical part 306A maintains a state where it abuts against the second cam surface 42B.

Subsequently, when the cutter helical gear 42 further rotates due to the rotation of the driving motor 43 and goes through the state illustrated in FIG. 23 (in this state, the cylindrical part 306A is away from the above described second cam surface 42B as described above) and further through the state illustrated in FIG. 24, and as illustrated in FIG. 25 rotates by 183°, for example, from the above described home position, then the above described arm part 305 of the actuating member 60 descends and abuts against the tilted part 304*b* of the above described locking piece 304, and presses the locking piece 304 downward, and then the blocking of the rotation of the driven part 203 by the locking pawl 304*a* is released, so that the roller shaft RS transitions to the above described transmission state from the above described interruption state (see FIG. 29A). At this time, the above described apex 306B of the actuating member 60 further advances to the above described tape feeding path TR side, so that holding with the above described second constant pressure ends. Hereinafter, the above described holding pressure will be held at a predetermined constant pressure which is higher than the above described second constant pressure. That is, the pressing roller 52 is caused to contact the label tape 109 from the opposite side of the driving roller 51 while being pressed with the above described first constant pressure. As the result, in a pressed state where the label tape 109 with print is sandwiched by the pressing roller 52 and driving roller 51, the rotation of the driving roller 51 is started to be transmitted to the label tape 109 with print. As a result, hereinafter the label tape 109 with print is started to be fed toward the label discharging port 11 due to the transmission of the rotation of the driving roller 51 due to the driving force of the driving motor 43.

Subsequently, when the cutter helical gear 42 further rotates by 205°, for example, from the above described home position due to the rotation of the driving motor 43, then as illustrated in FIG. 26 the cylindrical part 306A runs over the third cam surface 42C of the cutter helical gear 42 to cause the actuating member 60 to swing further counterclockwise. In a state (at the "highest point" in FIG. 29B) where the movable blade 41 advances to the farthest, the stationary blade 40 and the movable blade 41 bite with each other to overlap by a predetermined amount.

Subsequently, when the cutter helical gear 42 further rotates due to the rotation of the driving motor 43, then due to the action of the shape and direction of the long hole 49 of the handle part 46 of the movable blade 41, at a certain time point and thereafter the movable blade 41 starts rotating, about the above described rotary shaft 48, in a direction (clockwise in the view) away from the tape feeding path TR (see FIG. 27). As a result, the movable blade 41 starts separating from the label tape 109 with print.

Moreover, when the cutter helical gear 42 further rotates due to the rotation of the driving motor 43, the cylindrical part 306A of the actuating member 60 becomes away from the above described third cam surface 42C and thus the actuating member 60 pressed by the urging force of the spring member 62 also starts rotating about the above described rotary shaft 163 in a direction (clockwise in the view) opposite to the previous direction. Then, when the cutter helical gear 42 rotates by 320°, for example, from the above described home position, the above described arm part 305 of the actuating member 60 ascends again, and thus the abutting against the tilted part 304*b* of the above described locking piece 304 is released, and the locking pawl 304*a* of the locking piece 304 locks with the driven part 203 again, and the rotation of the driven part 302 is interrupted again, and the roller shaft RS transitions from the above described transmission state to the above described interruption state again (see FIG. 29A).

Then, when the cutter helical gear 42 rotates by 354°, for example, from the above described home position, as illustrated in FIG. 28 the above described pressing roller 52 separates from the tape feeding path TR of the label tape 109 with print to the rear side (right side in the view) via the apex 306B, coupling member 36, and roller supporting mechanism 307 due to the rotation in the opposite direction of the above described actuating member 60, resulting in the separated state again. Note that, in FIG. 25, the feed speed, and shape, dimension, material, and the like of each part are set so that the back end of the label L generated by cutting the label tape 109 with print arrives at least at the position of the driving roller 51 during the period after the rotation of the driving roller 51 due to the driving force of the driving motor 43 is transmitted and the label tape 109 with print is started to be fed until the state becomes the above described separated state again. Thus, the label L will be reliably discharged from the label discharging port 11.

Subsequently, when the cutter helical gear 42 further rotates due to the rotation of the driving motor 43, the movable blade 41 further retreats and separates from the tape feeding path TR (i.e., becomes the above described separated state again), and the cutter helical gear 42 rotates by 360° from the above described home position, then the actuating member 60 returns to the initial state corresponding to the above described home position. At this time, the first cam surface 42A of the cutter helical gear 42 appears again to push the microswitch 126 into the ON state (see the above described FIG. 28 and FIG. 27 which are immediately before this state), so that a fact is detected by the above described control circuit that the movable blade 41 has returned to the above described home position (see step S70 in FIG. 16).

As explained above, in this embodiment, in addition to the above described advancing and retreating operation of the above described movable blade 41 with respect to tape feeding path TR and the advancing and retreating operation of the above described pressing roller 52 with respect to the driving roller 51, the rotation of the above described driving roller 51 is also performed with the driving force from one common driving motor 43. That is, the driving force of the driving motor 43 is transmitted to the driving roller 51 via the roller shaft RS including the driving part 300, driven part 302, and coil spring 301. This roller shaft RS switches to operate between the transmission state where the driven part 302 rotates together with the driving part 300 and the interruption state where the driven part 302 will not rotate even if the driving part 300 rotates. In the above described transmission state, the driving roller 51 rotates corresponding to the driving motor 43 which rotates in one direction. Accordingly, when the pressing roller 52 advances as described above to sandwich the label tape 109 with print between the pressing roller 52 and the driving rollers 51, and in this state the roller shaft RS becomes in the above described transmission state, then the rotation of the driving roller 51 acts on the label tape 109 with print and the label tape 109 with print is fed in the discharge direction (in the case that the above described roller shaft RS is in the above described interruption state, the label tape 109 with print will not be fed).

At this time, in this embodiment, due to the adjustment using the above described actuating member 60 and the like, the roller shaft RS will not switch to the transmission state at least until the cutting of the label tape 109 with print by the movable blade 41 is complete, and the above described roller shaft RS switches to the transmission state after the cutting of the label tape 109 with print by the movable blade 41 is complete (see FIG. 29A and FIG. 29B). As a result, unlike the technique described in JP, A, 2012-139778, in which the rotational driving force of a driving motor is constantly transmitted to a pressing roller via a gear train, and the roller shaft RS rotates, the rotational driving force acting on the label tape 109 with print due to the rotation of the driving roller 51 before the completion of tape cutting can be prevented.

In this manner, in this embodiment, utilizing the driving force of one common driving motor 43, cutting of the label tape 109 with print by the movable blade 41 and the subsequent discharging of the label L can be reliably and smoothly performed. Accordingly, the number of motors can be reduced as compared with the case that a motor for driving the movable blade 41 and a motor for discharge a label are separately disposed. As the result, a reduction in size and a reduction in weight of the whole apparatus can be achieved, and a reduction in cost also can be achieved.

Moreover, in this embodiment, in particular the locking pawl 304*a* of the locking piece 304 locks the driven part 302 of the roller shaft RS so as to be unable to rotate at least until the completion of cutting of the label tape 109 with print by the movable blade 41, and releases the locking to the driven part 302 after completion of cutting of the label tape 109 with print by the movable blade 41, thereby allowing for the rotation of this driven part 302. As a result, at least until the completion of cutting of the label tape 109 with print by the movable blade 41, the locking piece 304*a* locks the driven part 302 so as to be unable to rotate, and so as to reliably prevent the rotational driving force from acting on the label tape 109 with print.

Moreover, in this embodiment, in particular the roller supporting mechanism 307 is disposed for supporting the pressing roller 52 so as to be able to rotate and advance and retreat. Here, with the actuating member 60, the above described pressing roller 52 supported by the roller supporting mechanism 307 advances and retreats with respect to the above described driving roller 51 in conjunction with the advancing and retreating operation of the movable blade 41 due to the rotation in the above described one direction of the driving motor 43. As a result, as the driving motor 43 rotates in one direction, the label tape 109 with print can be reliably cut by causing the movable blade 41 to advance and retreat, and the pressing roller 52 can be caused to reliably advance and retreat with respect to the driving roller 51.

Moreover, in this embodiment, in particular as the driving motor 43 rotates in one direction, the roller supporting mechanism 307 is caused to transition in the order of the above described separated state, the above described pressing state for cutting, the above described pressing state for feeding, and the above described separated state (see FIG. 29A). As a result, initially, as the driving motor 43 rotates in one direction, first the pressing roller 52 away from the label tape 109 with print at the beginning can be caused to advance to the driving roller 51 and set the state to a pressing state for cutting where the pressing roller 52 is pressed with a relatively small second constant pressure, and then set the state to the pressing state for feeding where the pressing roller 52 is pressed with a relatively large first constant pressure. As the result, when the label tape 109 with print has arrived at an appropriate cutting position, cutting with the above described movable blade 41 can be performed in the above described pressing state for cutting. Subsequently, the state is set to the above described pressing state for feeding, so that the label can be discharged by effecting the rotation from the above described driving roller 51. As explained above, cutting can be performed while pressing roller 52 is being pressed with a certain level of pressure, and cutting of the label tape 109 with print can be stably and precisely performed.

Moreover, in this embodiment, in particular when switched from the above described pressing state for cutting to the above described pressing state for feeding, the roller shaft RS is switched from the interruption state to the transmission state (see FIG. 29A). As a result, while the pressing force from the pressing roller 52 has reliably switched to a relatively large pressure corresponding to tape feeding, the rotational driving force from the driving roller 51 can be applied to the cover film 103.

Moreover, in this embodiment, in particular after the movable blade 41 completes cutting the label tape 109 with print having an assumed maximum width dimension (36 [mm] in the above described example), the state is switched from the above described pressing state for cutting to the above described pressing state for feeding (see FIG. 29A and FIG. 29B). As a result, in the case that various types of tapes (i.e., the cover film 103 and base tape 101: the same applies hereafter) each having a different width dimension are used, the rotational driving force can be reliably prevented from acting on the label tape 109 with print until completion of cutting even if a relatively narrow width tape is used.

Moreover, in this embodiment, in particular while the movable blade 41 is cutting the label tape 109 with print having an assumed minimum width dimension (6 [mm] in the above described example), the state is maintained in the above described pressing state for cutting. As a result, in the case that various types of tapes each having a different width dimension may be used, the label tape 109 with print can be pressed and held with at least a certain level of pressing force during the cutting operation even if a relatively narrow width tape is used.

Note that, in the above, a scheme has been employed, in which printing is performed on the cover film 103 separate from the base tape 101 and then the cover film 103 and the base tape 101 are bonded together, but not limited thereto, and a scheme (without bonding a cover film and a base tape together), in which printing is performed on a print-receiving tape layer in a base tape, may be employed in the present disclosure. In this case, the base tape is the label tape.

Moreover, in the above, the label producing apparatus 1 is connected to the PC 118 via the communication line NW, but not limited thereto. That is, the label producing apparatus 1 may include all the functions of the above described PC 118 and the like (the so-called a stand-alone label producing apparatus may be employed).

Moreover, the arrows illustrated in FIG. 12 and the like illustrate an example of the flow of a signal, and shall not limit the flow direction of the signal.

Moreover, the flow charts in the above described FIG. 15, FIG. 16, and the like shall not limit the present disclosure to the procedure shown in the above described flow, and a procedure may be added or deleted or the sequence of the procedure may be changed without departing from the scope and technical idea of the disclosure.

Moreover, other than the embodiments and variations described above, the procedures according to the above described embodiments and each variation may be combined and used, as needed.

What is claimed is:

1. A label producing apparatus comprising:

a feeder configured to feed a label tape;

a movable blade configured to advance and retreat with respect to a tape feeding path and cut said label tape fed by said feeder;

a driving roller disposed to a downstream side of said movable blade on said tape feeding path and configured to contact and discharge said label tape;

a driven roller configured to advance and retreat with respect to said tape feeding path;

a motor configured to rotate in one direction and generate a driving force;

a driving force transmission mechanism configured to perform a switching operation between a transmission state where said driving force of said motor is transmitted to said driving roller and an interruption state where the transmission of said driving force to said driving roller is interrupted, and wherein said driving force transmission mechanism includes:

a driving part configured to receive said driving force of said motor;

a driven part connected to said driving roller; and a friction transmission part configured to transmit said driving force by a frictional force between said driving part and said driven part;

an actuating member rotatably supported; and a coordination adjusting mechanism configured to adjust an advancing and retreating operation of said driven roller to said driving roller, an advancing and retreating operation of said movable blade to said tape feeding path, and said switching operation of said driving force transmission mechanism into a desired mutually coordinated-mode, these operations being performed by said driving force of said motor in accordance with a rotation of said motor in said one direction, wherein said coordination adjusting mechanism includes a lock mechanism configured to lock said driven part into said interruption state and release a locking to said driven part into said transmission state where rotation of said driven part is allowed, and wherein said lock mechanism includes:

a locking piece configured to lock with a groove located on an outer circumference of said driven part; and an arm part disposed to said actuating member and configured to be in contact with said locking piece.

2. The label producing apparatus according to claim 1, wherein said driven roller is configured to touch said label tape located on said tape feeding path from an opposite side with respect to said driving roller and sandwich said label tape together with said driving roller, said driving force transmission mechanism is configured to transmit said driving force in said transmission state so that said driving roller rotates in a direction along which said label tape is discharged in accordance with the rotation of said motor in said one direction, and said coordination adjusting mechanism is configured to cause said driven roller, said movable blade, and said driving force transmission mechanism to operate in coordination with each other so that said driving force transmission mechanism does not switch to said transmission state at least until completion of cutting of said label tape by said movable blade and said driving force transmission mechanism switches to said transmission state after completion of the cutting of said label tape by said movable blade.

3. The label producing apparatus according to claim 1, wherein said lock mechanism is configured to lock said driven part for being unable to rotate at least until completion of cutting of said label tape by said movable blade and to release a locking to said driven part after the completion of the cutting of said label tape by said movable blade.

4. The label producing apparatus according to claim 1, further comprising a supporting mechanism that supports said driven roller configured to rotate and to advance and retreat with respect to said driving roller, wherein said coordination adjusting mechanism includes:

a conversion mechanism configured to convert said rotation in said one direction of said motor to said advancing and retreating operation of said movable blade; and an interlocking mechanism configured to interlock with said advancing and retreating operation of said movable blade and cause said driven roller supported by said supporting mechanism to advance and retreat with respect to said driving roller.

5. The label producing apparatus according to claim 4, further comprising a movable blade driving gear configured to be engaged with said movable blade and driven by said motor, wherein said conversion mechanism includes:

a pin disposed to said movable blade driving gear; and an engagement hole disposed to said movable blade and engaged with said pin.

6. The label producing apparatus according to claim 4, wherein said interlocking mechanism includes:

a lower end part that is disposed on a lower end of said actuating member and slides on a cam surface of said movable blade driving gear; and an upper end part that is disposed on an upper end of said actuating member and connected to said supporting mechanism.

7. The label producing apparatus according to claim 1, further comprising a printing head configured to perform desired printing on said label tape fed by said feeder before arriving at a cutting position where said label tape is to be cut by said movable blade, wherein said movable blade is configured to cut said label tape printed by said printing head and to produce a print label.

8. A label producing apparatus comprising:

a feeder configured to feed a label tape;

a movable blade configured to advance and retreat with respect to a tape feeding path and cut said label tape fed by said feeder;

a driving roller disposed to a downstream side of said movable blade on said tape feeding path and configured to contact and discharge said label tape;

a driven roller configured to advance and retreat with respect to said tape feeding path;

a supporting mechanism that supports said driven roller configured to rotate and to advance and retreat with respect to said driving roller;

a motor configured to rotate in one direction and generate a driving force;

a driving force transmission mechanism configured to perform a switching operation between a transmission state where said driving force of said motor is transmitted to said driving roller and an interruption state where the transmission of said driving force to said driving roller is interrupted; and a coordination adjusting mechanism configured to adjust an advancing and retreating operation of said driven roller to said driving roller, an advancing and retreating operation of said movable blade to said tape feeding path, and said switching operation of said driving force transmission mechanism into a desired mutually coordinated-mode, these operations being performed by said driving force of said motor in accordance with a rotation of said motor in said one direction, wherein said coordination adjusting mechanism includes:

a conversion mechanism configured to convert said rotation in said one direction of said motor to said advancing and retreating operation of said movable blade; and an interlocking mechanism configured to interlock with said advancing and retreating operation of said movable blade and cause said driven roller supported by said supporting mechanism to advance and retreat with respect to said driving roller;

wherein said supporting mechanism is configured to switch among:

a pressing state for feeding where said driven roller is caused to contact said label tape from an opposite side of said driving roller while being pressed with a first constant pressure as said transmission state of said driving force transmission mechanism;

a pressing state for cutting where said driven roller is caused to contact said label tape from the opposite side of said driving roller while being pressed with a second constant pressure which is smaller than said first constant pressure as said interruption state of said driving force transmission mechanism; and a separated state where said driven roller is caused to separate, by a predetermined distance, from said label tape located on said tape feeding path as said interruption state of said driving force transmission mechanism, and said interlocking mechanism is configured to cause said supporting mechanism to transition in an order of said separated state, said pressing state for cutting, said pressing state for feeding, and said separated state, in accordance with the rotation of said motor in said one direction.

9. The label producing apparatus according to claim 8, wherein said coordination adjusting mechanism is configured to switch said driving force transmission mechanism from said interruption state to said transmission state, with said driving force of said motor when said supporting mechanism is switched by said interlocking mechanism from said pressing state for cutting to said pressing state for feeding.

10. The label producing apparatus according to claim 9, wherein said interlocking mechanism is configured to switch said supporting mechanism from said pressing state for cutting to said pressing state for feeding, after said movable blade completes cutting said label tape having an assumed maximum width dimension.

11. The label producing apparatus according to claim 9, wherein said interlocking mechanism is configured to maintain said supporting mechanism in said pressing state for cutting while said movable blade is cutting said label tape having an assumed minimum width dimension.

* * * * *